US009586747B2

(12) United States Patent
Zhang

(10) Patent No.: US 9,586,747 B2
(45) Date of Patent: Mar. 7, 2017

(54) THERMALLY INSULATING MEMBER

(71) Applicant: LIAN YI DESIGN ENTERPRISE CO., LTD., Kaohsiung (TW)

(72) Inventor: Shao-Wen Zhang, Kaohsiung (TW)

(73) Assignee: Lian Yi Design Enterprise Co., Ltd., Kaohsiung (TW)

( * ) Notice: Subject to any disclaimer, the term of this patent is extended or adjusted under 35 U.S.C. 154(b) by 195 days.

(21) Appl. No.: 14/616,804

(22) Filed: Feb. 9, 2015

(65) Prior Publication Data

US 2015/0151895 A1 Jun. 4, 2015

Related U.S. Application Data

(63) Continuation-in-part of application No. 14/264,282, filed on Apr. 29, 2014, now Pat. No. 9,169,056.

(30) Foreign Application Priority Data

May 3, 2013 (TW) ..... 102115888 A

(51) Int. Cl.

| | |
|---|---|
| ***B65D 81/38*** | (2006.01) |
| ***B65D 23/08*** | (2006.01) |
| ***B65D 25/34*** | (2006.01) |
| ***A47G 23/02*** | (2006.01) |

(52) U.S. Cl.

CPC ..... *B65D 81/3876* (2013.01); *A47G 23/0216* (2013.01); *B65D 23/08* (2013.01); *B65D 23/0892* (2013.01); *B65D 81/3865* (2013.01); *Y10T 428/24281* (2015.01); *Y10T 428/24298* (2015.01); *Y10T 428/24306* (2015.01);

(Continued)

(58) Field of Classification Search

None

See application file for complete search history.

(56) References Cited

U.S. PATENT DOCUMENTS 2,261,307 A * 11/1941 Still ..... E04B 1/80 112/441
3,655,501 A * 4/1972 Tesch ..... A47G 27/00 15/104.002

(Continued)

FOREIGN PATENT DOCUMENTS

| | | | |
|---|---|---|---|
| FR | 2319485 A1 | | 2/1977 |
| JP | 62000527 U | * | 1/1987 |
| TW | M465360 U | | 11/2013 |

*Primary Examiner* — Jeff Vonch

(74) *Attorney, Agent, or Firm* — Alan D. Kamrath; Kamrath IP Lawfirm, P.A.

(57) ABSTRACT

A thermally insulating member includes a plane sheet having two ends spaced in a length direction and two sides spaced in a thickness direction perpendicular to the length direction. The plane sheet includes a plurality of rows of slits between the ends of the plane sheet. Each row of slits extends from one of the sides through the other side of the plane sheet. A first spacing between two adjacent rows of slits in the length direction is larger than a spacing between two adjacent slits in the same row of slits in a width direction perpendicular to the length and width directions by a second spacing. A thermally insulating strip is defined between two adjacent rows of slits. A stretchable rib is formed between two adjacent slits in the same row of slits. Each end of the plane sheet is a coupling portion free of the slits.

15 Claims, 19 Drawing Sheets

(52) U.S. Cl.
CPC ..... *Y10T 428/24314* (2015.01); *Y10T 428/24694* (2015.01); *Y10T 428/24777* (2015.01)

(56) References Cited

U.S. PATENT DOCUMENTS 3,967,993 A * 7/1976 Isomi ..... B65D 23/0878 156/229
4,294,240 A * 10/1981 Thill ..... A61F 13/041 602/21
4,832,228 A * 5/1989 Hickey ..... A01K 31/007 119/174
4,957,791 A * 9/1990 Richter ..... B31D 1/0031 383/103
5,667,135 A 9/1997 Schaefer
5,667,871 A * 9/1997 Goodrich ..... B31C 5/00 206/521
5,688,578 A * 11/1997 Goodrich ..... B21D 31/04 206/521
6,250,545 B1 6/2001 Mazzarolo et al.
7,111,753 B2 * 9/2006 Scheetz, II ..... B65D 81/3879 215/12.1
7,263,790 B2 * 9/2007 Richards ..... B65D 25/36 150/901
8,486,507 B2 * 7/2013 De Luca ..... B29C 44/5654 428/131
8,608,018 B2 * 12/2013 Babinsky ..... B65D 81/3869 206/737
8,668,109 B2 * 3/2014 Dickert ..... B65D 81/3876 220/737
9,169,056 B2 * 10/2015 Zhang ..... A47G 23/0216
2004/0084460 A1 * 5/2004 Scheetz, II ..... B65D 81/3879 220/739
2004/0112949 A1 * 6/2004 Hed ..... B65D 3/14 229/403
2006/0289610 A1 * 12/2006 Kling ..... B65D 81/3865 229/4.5
2007/0122590 A1 * 5/2007 Lalvani ..... B32B 3/266 428/136
2007/0228134 A1 * 10/2007 Cook ..... B65D 81/3874 229/403
2008/0047967 A1 * 2/2008 Brunner ..... B65D 81/3886 220/737
2009/0321508 A1 * 12/2009 Fu ..... B29C 44/1233 229/403
2010/0019023 A1 * 1/2010 Silverstein ..... B31B 17/00 229/403
2012/0205430 A1 * 8/2012 Dickert ..... B65D 23/085 229/403
2012/0325836 A1 * 12/2012 Nenniger ..... A47G 23/0216 220/720
2013/0043263 A1 * 2/2013 Yang ..... B65D 25/2897 220/738
2016/0067938 A1 * 3/2016 Goodrich ..... B32B 3/266 428/136

* cited by examiner

THERMALLY INSULATING MEMBER

CROSS REFERENCE TO RELATED APPLICATIONS

This is a continuation-in-part application of U.S. patent application Ser. No. 14/264,282 filed on Apr. 29, 2014.

BACKGROUND OF THE INVENTION

1. Field of the Invention

The present invention relates to a thermally insulating member and, more particularly, to a structure of a thermally insulating member providing an excellent thermally insulating effect such that a container with high temperature is able to be held via the thermally insulating member.

2. Description of the Related Art

With reference to FIGS. 1 and 2, a conventional thermally insulating member 9 includes a sheet. Two ends of the sheet are adapted to couple with each other, so the thermally insulating member 9 can form a cyclic structure. The sheet of the thermally insulating member 9 mainly includes a wavy thermally insulating layer 91 and a surface layer 92. The thermally insulating layer 91 is bonded to the surface layer 92 by an adhesive.

In use of the conventional thermally insulating member 9, it is wrapped around an outer periphery of a container C. The thermally insulating layer 91 abuts against the outer periphery of the container C, and the surface layer 92 allows a user to hold the thermally insulating member 9. Since the thermally insulating layer 91 is wavy, the thermally insulating layer 91 is in discontinuous contact with the outer periphery of the container C to reduce direct transmission of the high temperature from the contents in the container C to the thermally insulating member 9. Thus, if the temperature of the contents inside the container C is high or the container C is heated by a heating device such as a microwave, the user can directly hold the thermally insulating member 9 to avoid scalding by the high temperature of contents in the container C, providing the user with convenience while holding the container C.

Although the conventional thermally insulating member 9 can insulate the high temperature of contents in the container C, the thermally insulating effect of the thermally insulating member 9 is mainly provided by reducing the contact area between the thermally insulating layer 91 and the container C by discontinuous contact. However, the thermally insulating layer 91 of the thermally insulating member 9 is wavy and, thus, contacts with the container C by a strip-shaped area, which is still relatively large. Besides, the insulating layer 91 is in adhesion the surface layer 92 and, thus, provides a limited thermally insulating effect. Once the contact time between the insulating member 9 and the container C is too long, the high temperature of the contents in the container C will be transmitted to the surface layer 92 via the insulating layer 91, eventually. Namely, the thermally insulating effect of the conventional thermally insulating member 9 should be improved.

Furthermore, with reference to FIG. 1, the conventional thermally insulating member 9 is in a flattened state when not in use. To avoid the loss of the thermally insulating effect of the thermally insulating layer 91, the wavy shape of the thermally insulating layer 91 must not be destroyed no matter in the storage or transportation state. Thus, the conventional thermally insulating member 9 occupies a considerable space in storage or during transportation. Particularly, the large volume of the conventional thermally insulating member 9 results in a high transportation cost and causes high storage costs to persons using the thermally insulating member 9.

Thus, how to provide a thermally insulating member that is low cost in use while providing an excellent thermally insulating effect is a problem to be solved by the manufacturers of the thermally insulating members.

SUMMARY OF THE INVENTION

What is needed is a thermally insulating member able to provide a plane sheet before use for reducing the volume of a plurality of thermally insulating members.

Another need is a thermally insulating member including a sheet with a plurality of broken lines for improving the thermally insulating effect of the thermally insulating member A further another need is a thermally insulating member with the sheet stretched outward by a outer surface of the container when the sheet is mounted around the container to provide a plurality of heat dissipating holes, further improving the thermally insulating effect of the thermally insulating member.

The present disclosure fulfills the above objective by providing:

A thermally insulating member comprises a sheet. The sheet includes a first direction and a second direction perpendicular to each other. The sheet is able to form a cyclic structure encircling the second direction. The sheet includes a plurality of broken lines extending along the second direction, and two adjacent broken lines are spaced from each other in the first direction. Each broken line includes a plurality of slits, and two adjacent slits are spaced from each other in the second direction.

In an embodiment of the thermally insulating member according to the present disclosure, two ends of each slit of the broken lines respectively connect a pre-fold line, and the pre-fold line extends towards two sides of the sheet in the first direction.

For the above mentioned thermally insulating member, the sheet means for being mounted around a container, and the cyclic structure has a first state and a second state. The cyclic structure has a first circumference in the first state, and the first circumference is smaller than a circumference of the outer surface of the container. The cyclic structure has a second circumference in the second state, and the second circumference is equal to the circumference of the outer surface of the container. The sheet is stretched outward by the container to transform the cyclic structure from the first state into the second state. The pre-fold lines connected to the two ends of each slit are bended to form fold lines, and the fold lines also extends towards the two sides of the sheet 1 in the first direction.

For the above mentioned thermally insulating member, each broken line is parallel to the second direction.

In another embodiment of the thermally insulating member according to the present disclosure, each slit has a first section aligned with the second direction, and two ends of the first section respectively connects a second section. The two second sections extend towards a side of the sheet in the first direction.

For the above mentioned thermally insulating member, the sheet means for being mounted around a container. The cyclic structure has a first state and a second state. The cyclic structure has a first circumference in the first state, and the first circumference is smaller than a circumference of the outer surface of the container. The cyclic structure has a second circumference in the second state, and the second circumference is equal to the circumference of the outer surface of the container. The sheet is stretched outward by the container to transform the cyclic structure from the first state into the second state. A thermally insulating strip is defined between two adjacent broken lines. Each of the second sections provides a guiding force to bend the adjacent thermally insulating strip and form a fold line on the sheet.

The plurality of slits of two adjacent broken lines is arranged in a staggered manner in the first direction.

The plurality of slits of two adjacent broken lines is arranged in an overlapping staggered manner in the first direction. A slit of one of the broken lines overlaps with another slit of the other broken line in the first direction, and the two slits are located in different positions in the second direction.

A thermally insulating strip is defined between two adjacent broken lines, and each thermally insulating strip has two ends spaced from each other in the second direction. Each end of the thermally insulating strip has at least one rounded corner.

The sheet has two peripheries spaced from each other in the second direction. The slits communicating with one of the peripheries have a first length, and the slits communicating with the other periphery have a second length. The first length is longer than the second length.

The sheet has two sides spaced from each other in the first direction. Each side of the sheet has a coupling portion. The plurality of broken lines is arranged between the two coupling portions, and the two coupling portions are able to couple with each other.

The sheet has a separation portion located between the two coupling portions, and the plurality of broken lines is arranged between the separation portion and each of the coupling portions.

Two adjacent broken lines are spaced from each other in the first direction by a spacing, and the spacings of every two adjacent broken lines are even.

Two adjacent broken lines are spaced from each other in the first direction by a spacing. The sheet has an axis parallel to the second direction, and the spacings of every two adjacent broken lines decrease or increase from the axis towards the two coupling portions One of the coupling portions is applied with an adhesive, and the other coupling portion is bonded to the coupling portion with the adhesive to form the sheet in the cyclic structure.

A coupling mechanism is formed on the two coupling portions. The coupling mechanism includes a coupling member in one of the coupling portions and a coupling hole on the other coupling portion.

The sheet means for being mounted around a container. The cyclic structure has a first state and a second state. The cyclic structure has a first circumference in the first state, and the first circumference is smaller than a circumference of the outer surface of the container. The cyclic structure has a second circumference in the second state, and the second circumference is equal to the circumference of the outer surface of the container. The sheet is stretched outward by the container to transform the cyclic structure from the first state into the second state.

A thermally insulating strip is defined between two adjacent broken lines. Each of the junctions between the thermally insulating strips and the plurality of slits of the broken lines forms a rib, and a distance is formed between each rib and the outer surface of the container. Each of the portions of the insulating strips connected to the spacing portions between the plurality of slits forms a stretchable rib.

For two thermally insulating strips adjacent to each other, a rib of one of the thermally insulating strips is align with a stretchable rib of the other thermally insulating strip in the first direction A heat dissipating hole is defined between rib and the stretchable rib, and the heat dissipating hole penetrates through the sheet and communicates with the outer surface of the container.

The effect achieved by the above technical solution is that the thermally insulating member includes a sheet, with the sheet includes a plurality of flat thermally insulating strips before use, effectively reducing the volume of a plurality of thermally insulating members. On the other hand, the sheet includes a plurality of broken lines, and each broken line includes a plurality of slits. A thermally insulating strip can be defined between two adjacent broken lines, such that the sheet is stretched outward by a outer surface of the container when the sheet is mounted around the container to force the cyclic structure formed by the sheet to transform from a first state into a second state, and ribs and stretchable ribs are formed on each thermally insulating strip. A heat dissipating hole is defined between the rib of one of the thermally insulating strips and the stretchable rib of another adjacent thermally insulating strip, effectively improving the thermally insulating effect of the thermally insulating member.

BRIEF DESCRIPTION OF THE DRAWINGS

The illustrative embodiments may best be described by reference to the accompanying drawings where.

The present disclosure will become clearer in light of the following detailed description of illustrative embodiments of this disclosure described in connection with the drawings.

DETAILED DESCRIPTION OF THE INVENTION

Figure 1:
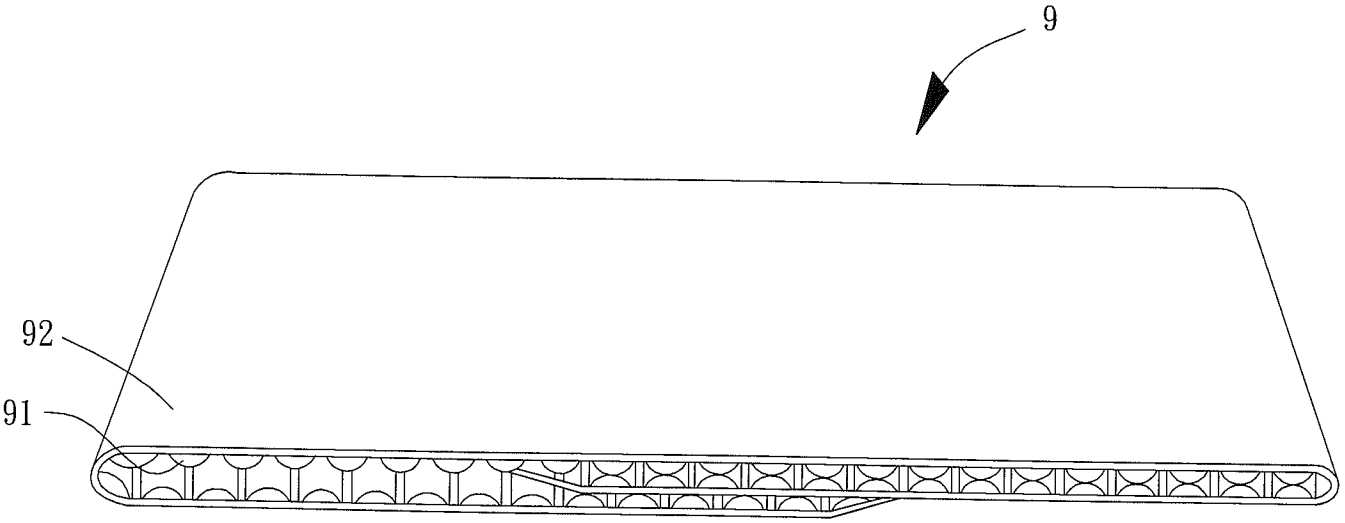
FIG. 1 PRIOR ART
FIG. 1 is a perspective view of the conventional thermally insulating member in a flattened state.
Figure 2:
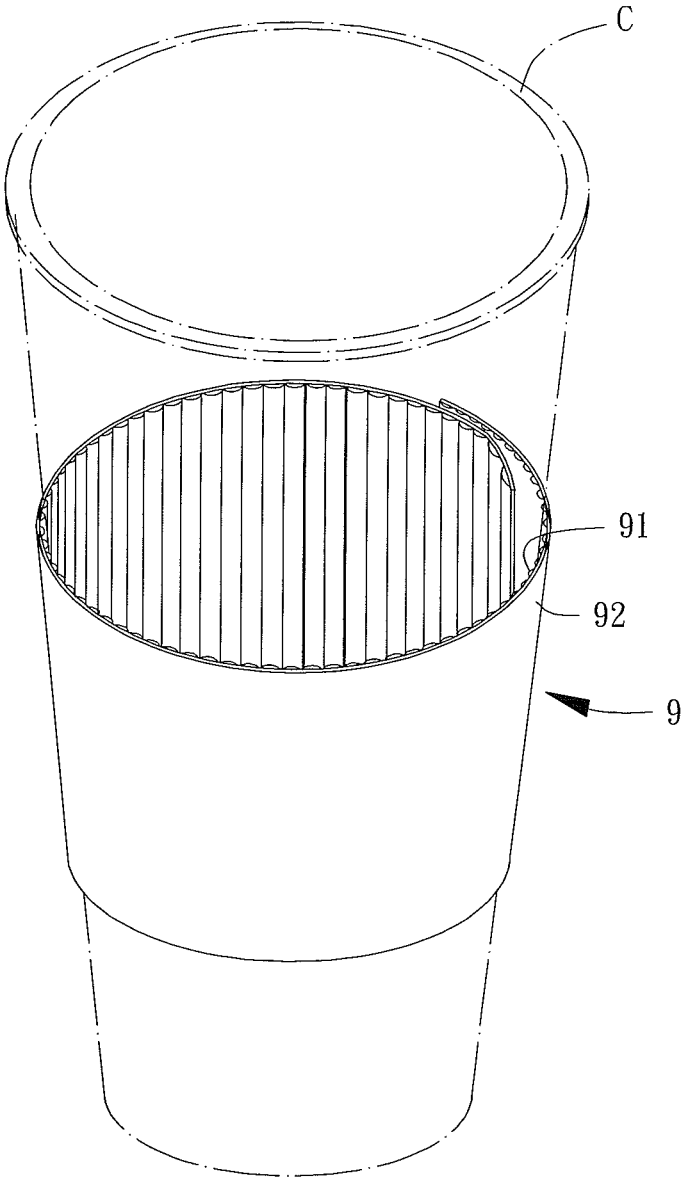
FIG. 2 PRIOR ART
FIG. 2 is a perspective view illustrating use of a conventional thermally insulating member.
Figure 3A:
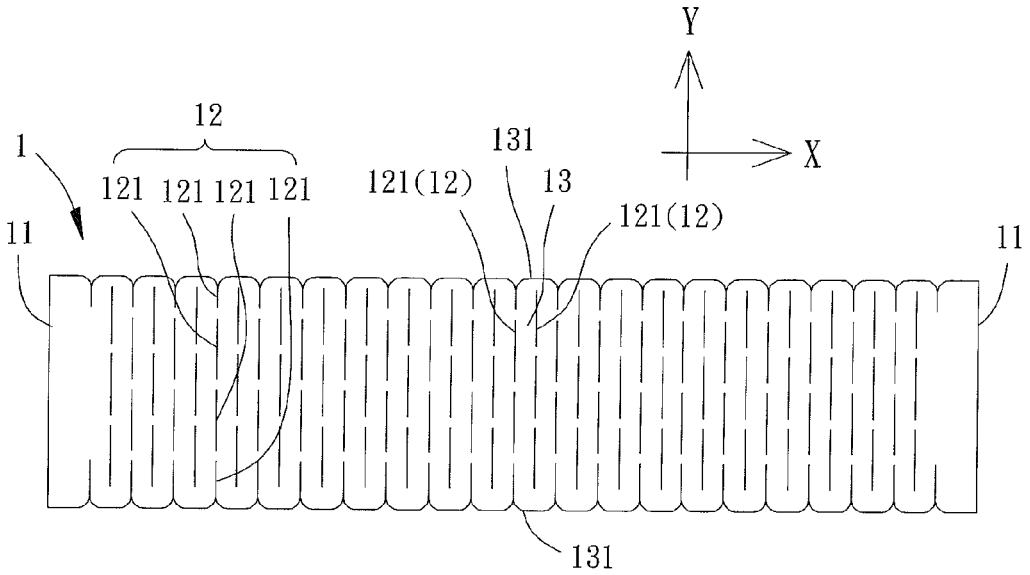
FIG. 3*a* is a perspective view of a thermally insulating member of a first embodiment according to the present disclosure.

With reference to FIG. 3*a*, a thermally insulating member of a first embodiment of this disclosure includes a sheet 1. The sheet 1 is generally made of paper, plastic material or other tough material. The sheet 1 includes a first direction X and a second direction Y perpendicular to each other. The sheet 1 has two sides spaced from each other in the first direction X. The two sides of the sheet 1 are able to couple with each other so that the sheet 1 can form a cyclic structure encircling the second direction Y. Namely, the sheet 1 can be folded circular with respect to the second direction Y as an axis and, thus, the sheet 1 is able to form the cyclic structure. The sheet 1 includes a plurality of broken lines 12 extending along the second direction Y. Two adjacent broken lines 12 are spaced from each other in the first direction X. Each broken line 12 includes a plurality of discontinuous slits 121. Namely, two adjacent slits 121 are spaced from each other in the second direction Y. The plurality of slits 121 of two adjacent broken lines 12 can be arranged in a staggered manner in the first direction X.

Since two adjacent broken lines 12 are spaced from each other in the first direction X, a flat thermally insulating strip 13 is defined between two adjacent broken lines 12. Each thermally insulating strip 13 has two ends spaced from each other in the second direction Y. Each end of the thermally insulating strip 13 has at least one rounded corner 131. Specifically, a thermally insulating strip 13 separates two adjacent broken lines 12 from each other. Since two adjacent slits 121 of a broken line 12 are spaced from each other in the second direction Y, a spacing portion is formed between two adjacent slits 121. Two adjacent thermally insulating strips 13 can connect each other via the spacing portions between the plurality of slits 121, and thus the two adjacent thermally insulating strips 13 will not detach from each other.

Figure 3B:
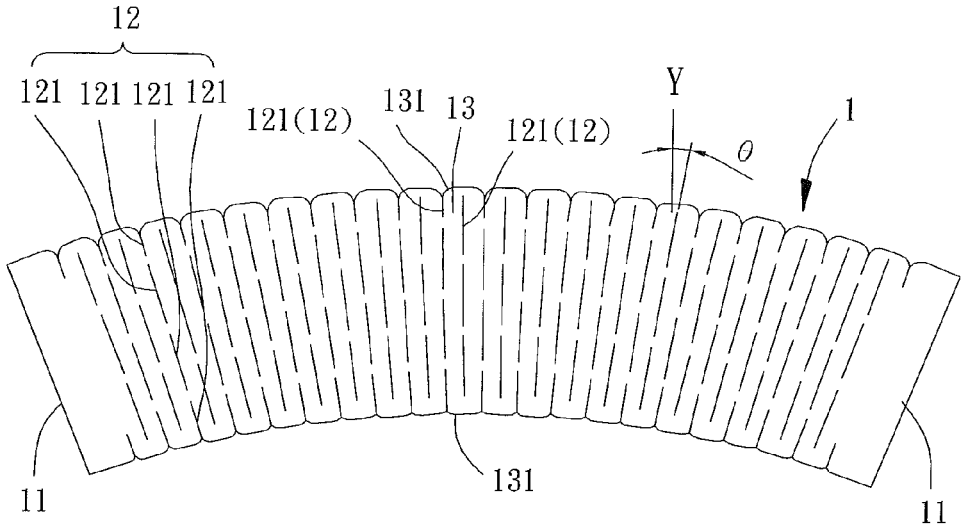
FIG. 3*b* is a perspective view of another example of the thermally insulating member of the first embodiment according to the present disclosure.

In this embodiment, each broken line 12 is parallel to the second direction Y. Namely, the plurality of slits 121 of each broken line 12 is parallel to the second direction Y. However, with reference to FIG. 3*b*, another example of the sheet 1 of the thermally insulating member of the first embodiment is in a curved shape. Precisely, the sheet 1 has two peripheries spaced from each other in the second direction Y, and each periphery is in a curved shape. Therefore, the plurality of broken lines 12 can be unparallel to the second direction Y, that is an angle θ can be formed between each broken line 12 and the second direction Y. Besides, the angles θ between each broken line 12 and the second direction Y can be different. Since the plurality of broken lines 12 can be unparallel to the second direction Y, the expression "the plurality of broken lines 12 extends along the second direction Y" refers to that the angles θ between each broken line 12 and the second direction Y are smaller than 45°, and it can be understood by one of ordinary skill in the art.

Figure 4A:
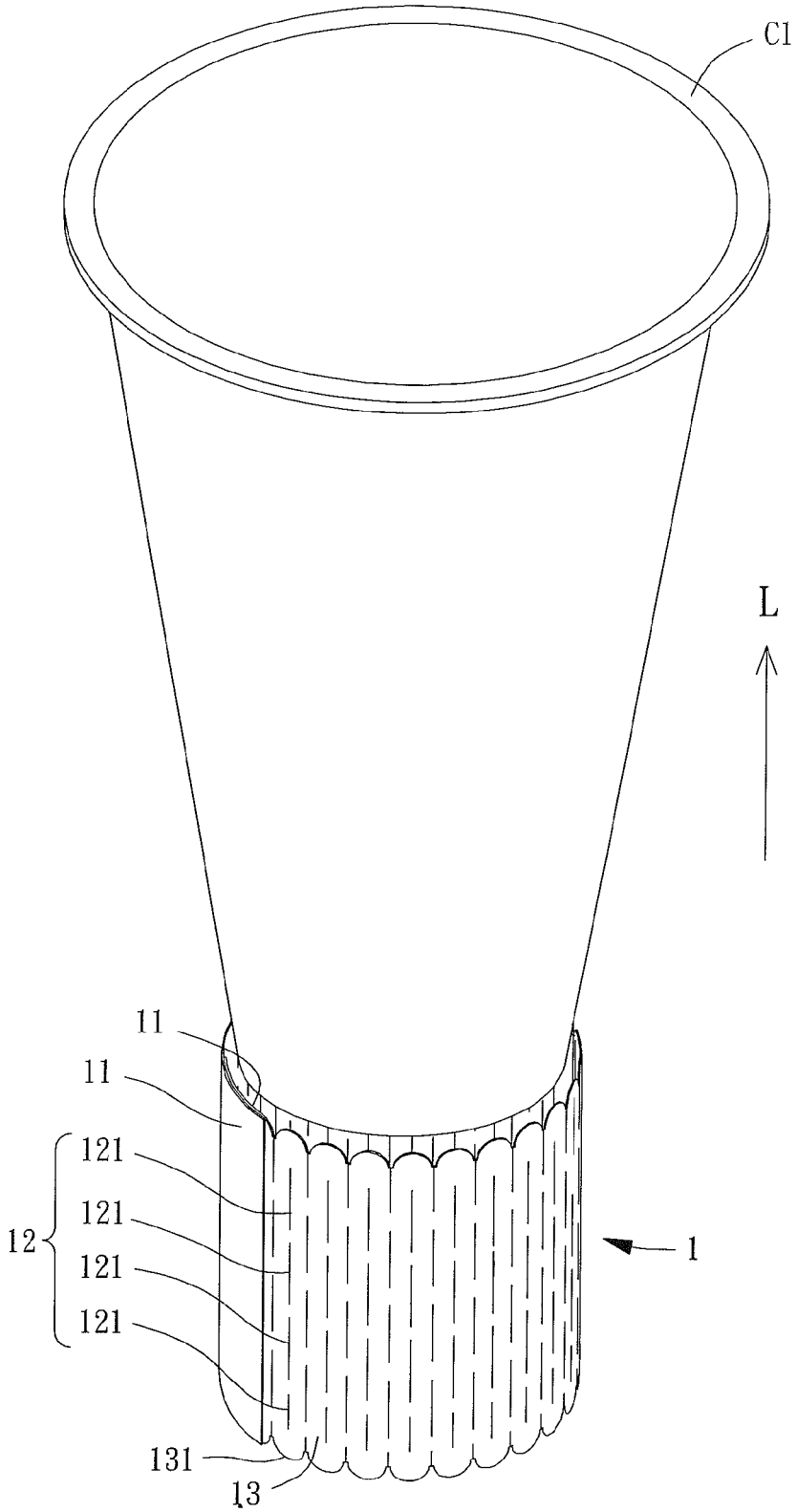
FIG. 4*a* is a perspective view illustrating the thermally insulating member of the first embodiment according to the present disclosure formed in a tubular shape.
Figure 4B:
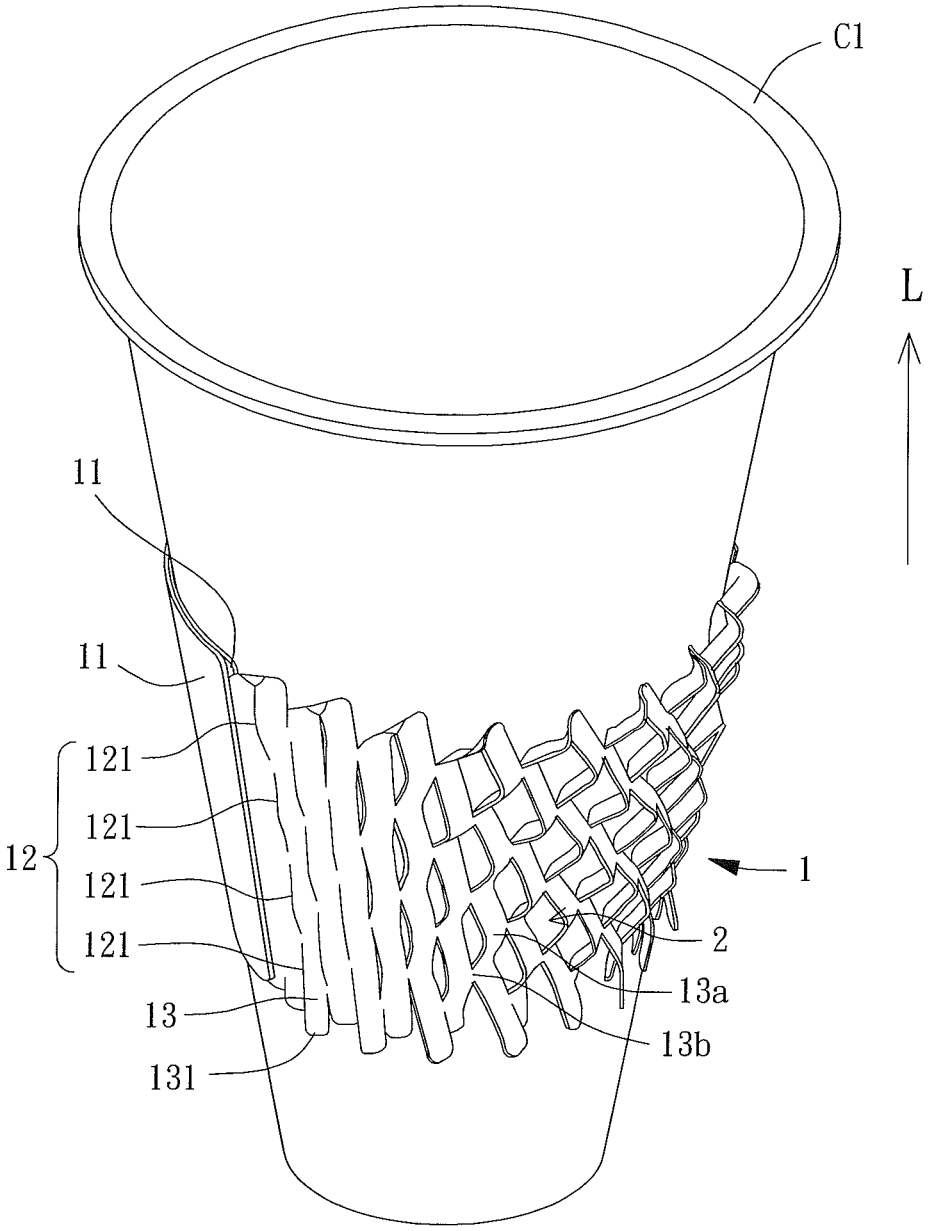
FIG. 4*b* is a perspective view illustrating use of the thermally insulating member of the first embodiment according to the present disclosure on a container.

With reference to FIG. 4*a*, in use of the thermally insulating member of the first embodiment, the two sides of the sheet 1 are coupled with each other by an adhesive or a stapling nail to form a cyclic structure, and thus the thermally insulating member of the first embodiment is formed in a tubular shape. However, in this embodiment, each side of the sheet 1 has a coupling portion 11. The plurality of broken lines 12 is arranged between the two coupling portions 11. One of the coupling portions 11 is applied with an adhesive, and the other coupling portion 11 is bonded to the coupling portion 11 with the adhesive to form the sheet 1 according to the present invention in the cyclic structure. Thereby, the sheet 1 can be directly mounted around a cylindrical container C1 (such as a cup). The outer surface of the container C1 has diameters increasing along a longitudinal direction L. The minimum diameter of the container C1 can be equal to the inner diameter of the cyclic structure, while the maximum diameter of the container C1 can be larger than the inner diameter of the cyclic structure. Therefore, the sheet 1 can be mounted around the container C1 from a portion thereof with the minimum diameter, namely, from below the container C1. With reference to FIG. 4*b*, since the minimum diameter of the container C1 is equal to the inner diameter of the cyclic structure, and the outer surface of the container C1 has diameters increasing along a longitudinal direction L, the sheet 1 is stretched outward by the container C1 during slide along the outer surface thereof in the longitudinal direction L. Besides, the sheet 1 can be positioned around the container C1 in a predetermined location, and the outer surface of the container C1 at the predetermined location has a surface circumference larger than the circumference of the cyclic structure.

Specifically, the sheet 1 forms the cyclic structure encircling the second direction Y, and the cyclic structure has a first state and a second state. With reference to FIG. 4*a*, the cyclic structure is in the first state while the container C1 does not stretch it outward. The cyclic structure has a first circumference in the first state, and the first circumference is smaller than the surface circumference. Thus, with reference to FIG. 4*b*, the sheet 1 will be stretched outward by the container C1 during slide along the outer surface thereof in the longitudinal direction L, so that the sheet 1 can be positioned in the predetermined location and the cyclic structure transforms from the first state into the second state. The cyclic structure has a second circumference in the second state, and the second circumference is equal to the surface circumference.

Meanwhile, when the cyclic structure transforms into the second state, since the sheet 1 has a plurality of broken lines 12, each of the junctions between the thermally insulating strips 13 and the plurality of slits 121 of the broken lines 12 will deflect away from the container C1 to form a rib 13*a*. Relatively, each of the portions of the insulating strips 13 that is not connected to the plurality of slits 121, namely, each of the portions of the insulating strips 13 connected to the spacing portions between the plurality of slits 121, will form a stretchable rib 13*b*. The stretchable ribs 13*b* abut against the outer surface of the container C1. Since two adjacent slits 121 are spaced from each other in the second direction Y, the ribs 13*a* and the stretchable ribs 13*b* are formed on each thermally insulating strip 13 in a staggered manner, such that the thermally insulating strips 13 become slanted, protrusive, and wavy.

Figure 5:
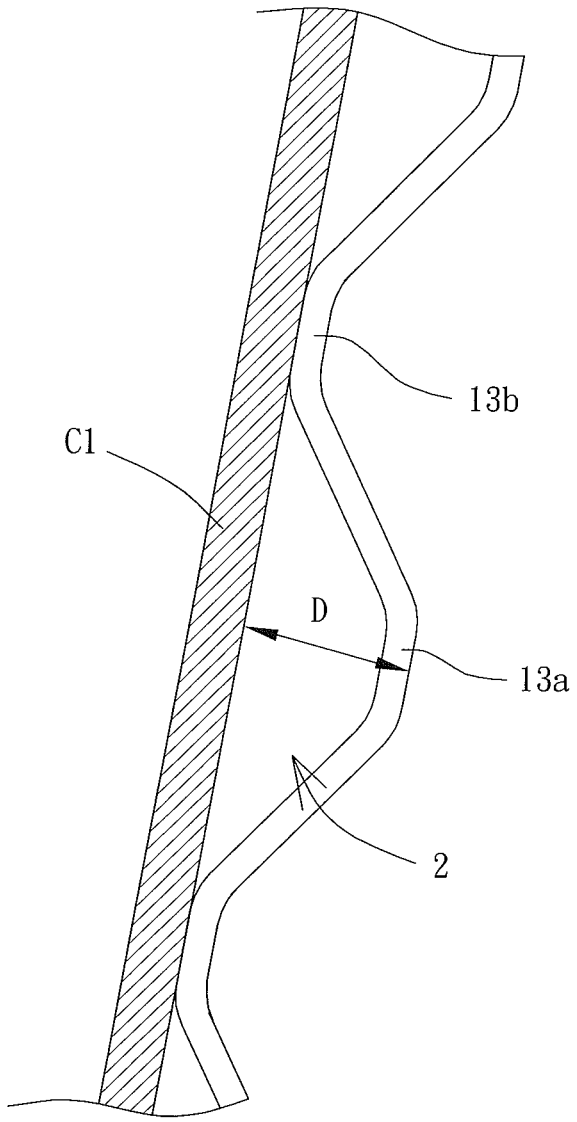
FIG. 5 is an enlarged view illustrating use of the thermally insulating member of the first embodiment according to the present disclosure on a container.

More specifically, with reference to FIG. 5, a distance D is formed between each rib 13*a* and the outer surface of the container C1. Since the plurality of slits 121 of two adjacent broken lines 12 can be arranged in a staggered manner, for two thermally insulating strips 13 adjacent to each other, a rib 13*a* of one of the thermally insulating strips 13 can align with a stretchable rib 13*b* of the other thermally insulating strip 13 in the first direction X. Thus, after the thermally insulating strips 13 become wavy, a substantially rhombic heat dissipating hole 2 is defined between the rib 13*a* of one of the thermally insulating strips 13 and the stretchable rib 13*b* of the other thermally insulating strip 13. The heat dissipating holes 2 penetrate through the sheet 1 and communicate with the outer surface of the container C1.

Due to Newton's third law, the sheet 1 is stretched outward by the container C1 with the stretchable ribs 13*b* of the thermally insulating strips 13 abutting against the outer surface of the container C1 and, thus, provides a wrapping and tightening effect by the physical properties such as a reaction force of the sheet 1. Thus, the sheet 1 can tightly abut around the container C1 without the risk of disengagement. An end of each rib 13 of the thermally insulating strips 13 away from the container C1 allows a user to hold. Since the sheet 1 includes a plurality of thermally insulating strips 13, and each thermally insulating strip 13 can form a plurality of ribs 13, the ribs 13 can share the pressure came from a hand of the user in order to prevent the thermally insulating strips 13 from excessive deformation. Therefore, the sheet 1 is ensured to contact the container C1 only through the stretchable ribs 13*b*. On the other hand, each end of the thermally insulating strip 13 has at least one rounded corner 131. The rounded corner 131 can prevent the user from getting cut by the peripheries of the sheet 1, especially while the user grabs the sheet 1 in quick motion.

In accordance with the above structure, FIG. 3*a* shows the thermally insulating member of the first embodiment of this disclosure in a spread out state before use. The thermally insulating strips 13 are flat, and the cyclic structure formed by the sheet 1 is in the first state, such that the thermally insulating member is mainly formed by the plane sheet 1. In comparison with the conventional thermally insulating member 9 which has a wavy thermally insulating layer 91 with greater thickness, the sheet 1 of the thermally insulating member of the first embodiment is plane with smaller thickness and, thus, has a limited height after stacking, effectively reducing the volume and costs of a plurality of thermally insulating members in storage or during transportation.

Besides, a thermally insulating strip 13 is defined between two adjacent broken lines 12 because of the two adjacent broken lines 12 are spaced from each other in the first direction X. Each broken line 12 includes a plurality of slits 121, with two adjacent slits 121 spaced from each other in the second direction Y. When the sheet 1 is positioned around the container C1 in the predetermined location, the outer surface of the container C1 at the predetermined location has the surface circumference larger than the circumference of the cyclic structure formed by the sheet 1 since the diameter of the container C1 at the predetermined is larger than the inner diameter of the cyclic structure. Thus, the sheet 1 will be stretched outward by the container C1 and the cyclic structure thereof transform from the first state into the second state. The ribs 13*a* and the stretchable ribs 13*b* are formed on each thermally insulating strip 13 in a staggered manner, with a distance D formed between each rib 13*a* and the outer surface of the container C1, and with the stretchable ribs 13*b* abutting against the outer surface of the container C1. In this case, the sheet 1 is in point contact with the container C1. In comparison with the conventional thermally insulating member 9 which contacts with the container C by a strip-shaped area, which is still relatively large, the sheet 1 of the thermally insulating member of the first embodiment is in point contact with the container C1 and, thus, has a limited contact area, effectively reducing the rate of the temperature transmission between the container C1 and the sheet 1. As a result, the thermally insulating effect of the thermally insulating member of the first embodiment is improved.

In addition, in this embodiment, the sheet 1 can be made of paper or plastic material. When the cyclic structure formed by the sheet 1 is in the second state, for two thermally insulating strips 13 adjacent to each other, a heat dissipating hole 2 is defined between the rib 13*a* of one of the thermally insulating strips 13 and the stretchable rib 13*b* of the other thermally insulating strip 13. In other words, the sheet 1 includes a plurality of heat dissipating holes 2 distributed on it. The heat dissipating holes 2 penetrate through the sheet 1 and communicate with the outer surface of the container C1 and, thus, the heat dissipating holes 2 are fulfilled with air. The thermal conductivity of air is about 0.024 W/mK, which is lower than the thermal conductivity of paper or plastic material (about 0.05 W/mK). Therefore, in comparison with the conventional thermally insulating member 9 that the high temperature of the contents in the container C will be transmitted to the surface layer 92 via the insulating layer 91, the sheet 1 of the thermally insulating member of the first embodiment includes a plurality of heat dissipating holes 2 penetrating through it, and, thus, the air in the heat dissipating holes 2 can reduced the rate of the temperature transmission on the sheet 1, further improving the thermally insulating effect of the thermally insulating member of the first embodiment.

Noted that in this embodiment, the plurality of slits 121 of two adjacent broken lines 12 can be arranged in a staggered manner in the first direction X, so that for two thermally insulating strips 13 adjacent to each other, a rib 13*a* of one of the thermally insulating strips 13 is align with a stretchable rib 13*b* of the other thermally insulating strip 13, and a heat dissipating hole 2 is defined between the two adjacent thermally insulating strips 13. The plurality of slits 121 of two adjacent broken lines 12 can be arranged in an overlapping staggered manner in the first direction X. That is, a slit 121 of one of the broken lines 12 overlaps with another slit 121 of the other broken line 12 in the first direction X, and the two slits 121 are located in different positions in the second direction Y. However, the plurality of slits 121 of two adjacent broken lines 12 can be arranged in a non-overlapping staggered manner in the first direction X. That is, a slit 121 of one of the broken lines 12 does not overlap with any other slit 121 of the other broken line 12 in the first direction X. The present disclosure does not limit the plurality of slits 121 of two adjacent broken lines 12 to be arranged in the overlapping or non-overlapping staggered manner. Yet the plurality of slits 121 of two adjacent broken lines 12 can be arranged in an alignment manner in the first direction X as long as the slits 121 of the two adjacent broken lines 12 have different lengths or shapes. Namely, a heat dissipating hole 2 can still be defined between the two adjacent thermally insulating strips 13 by the slits 121 with different lengths or shapes. The present disclosure does not limit the plurality of slits 121 of two adjacent broken lines 12 to be arranged in the staggered manner or alignment manner in the first direction X.

Figure 6:
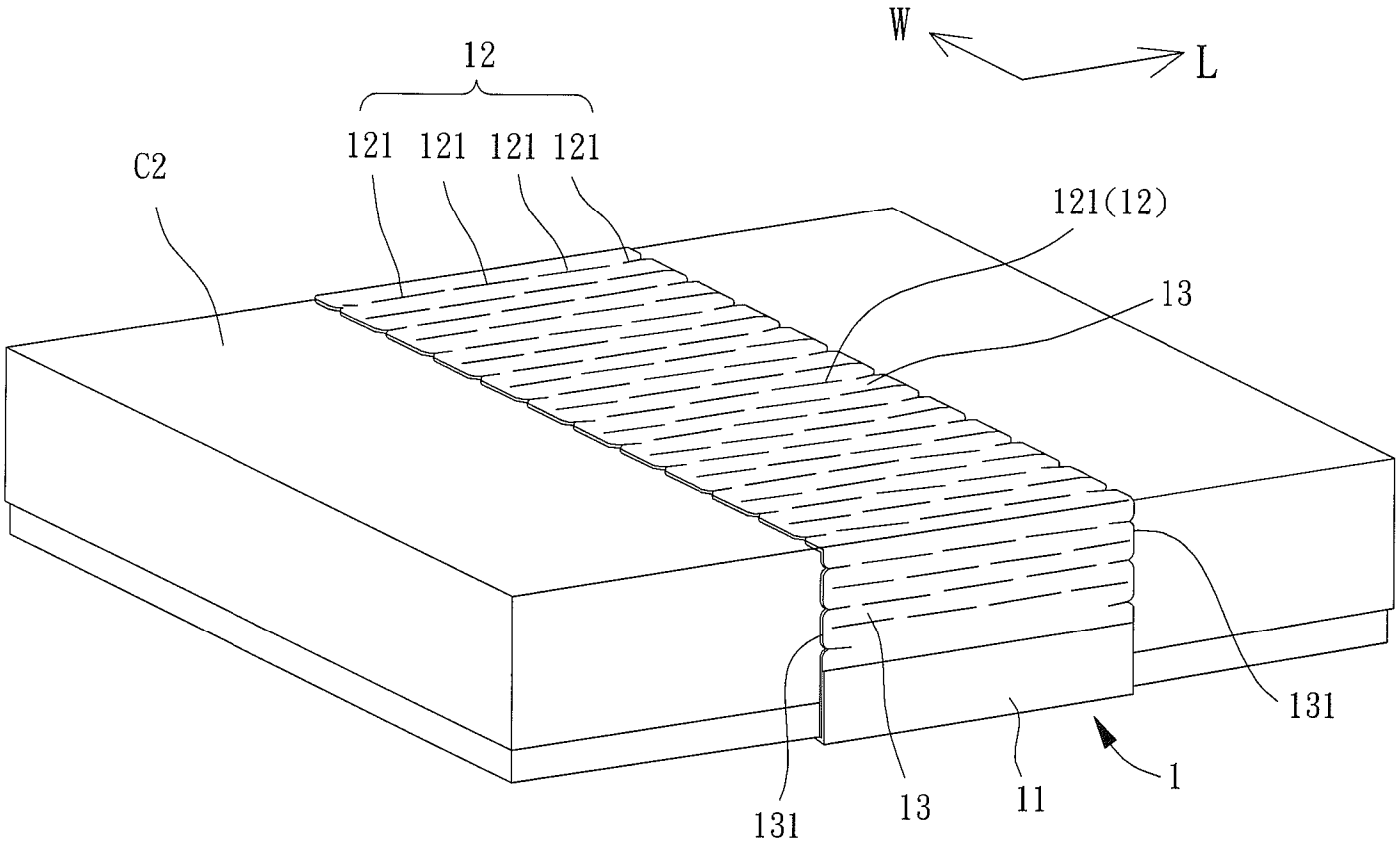
FIG. 6 is a perspective view illustrating use of the thermally insulating member according to the present disclosure of a meal box along a lateral direction.

With reference to FIG. 6, when using the thermally insulating member of the first embodiment of this disclosure on a box-shaped container C2 (such as a meal box), since the box-shaped container C2 is a parallelepiped, the box-shaped container C2 has a longitudinal direction L and a the lateral direction W, and the box-shaped container C2 has a width in the lateral direction W shorter than a length in the longitudinal direction L. Therefore, the outer surface of the box-shaped container C2 has a circumference in the lateral direction W smaller than a circumference in the longitudinal direction L. Besides, the circumference in the lateral direction W can be equal to or smaller than the first circumference of the cyclic structure formed by the sheet 1, and the circumference in the longitudinal direction L can be larger than the first circumference. By such arrangement, the sheet 1 can be wrapped around the box-shaped container C2 along the lateral direction W. Since the circumference in the lateral direction W is equal to or smaller than the first circumference of the cyclic structure, the sheet 1 will not be stretched outward by the outer surface of the box-shaped container C2, and the cyclic structure maintains the first state. As a result, the sheet 1 is not stretched and is plane, so that the box-shaped containers C2 are easy to be stacked and stored.

Figure 7:
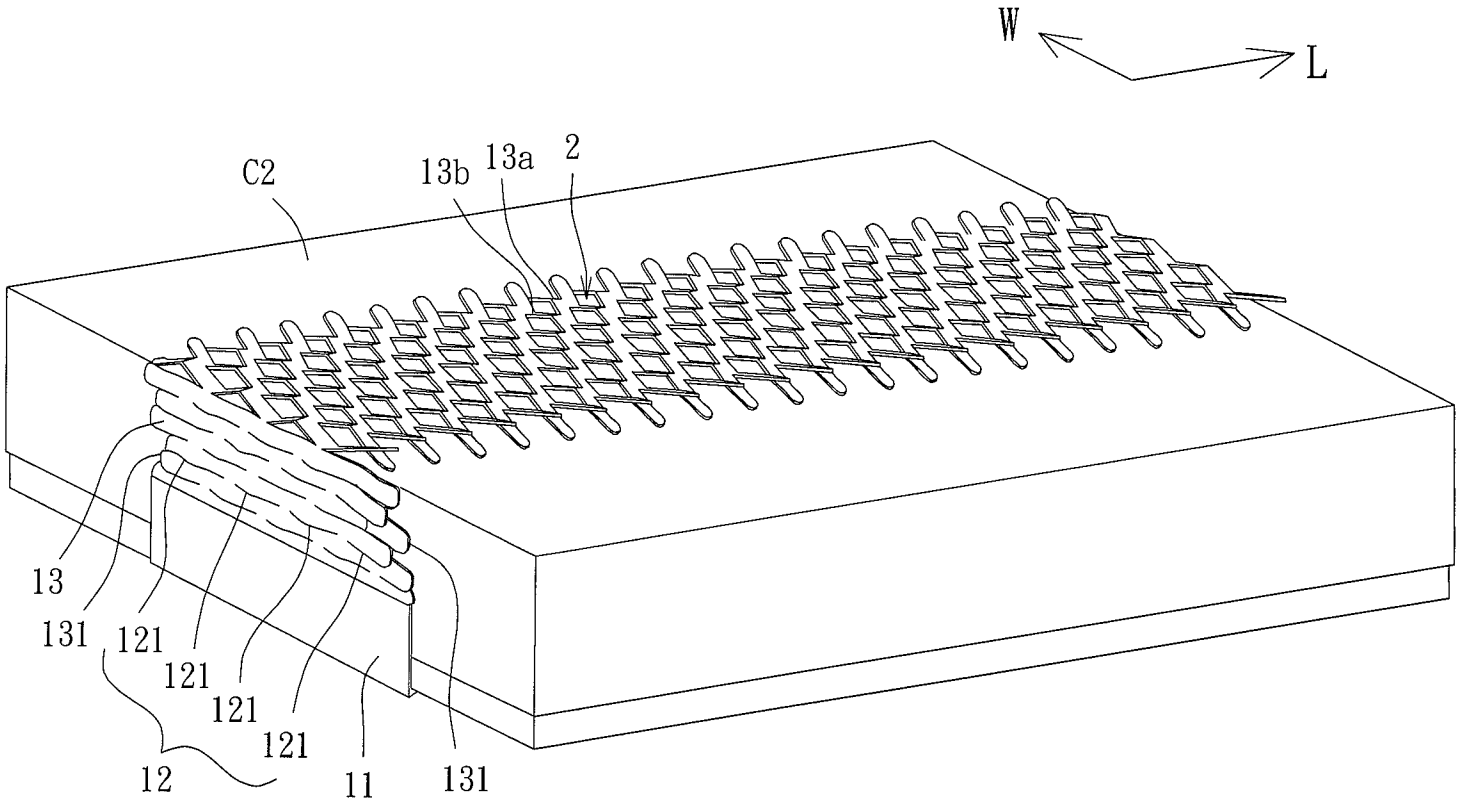
FIG. 7 is a perspective view illustrating another use of the thermally insulating member according to the present disclosure on the meal box along a longitudinal direction.

With reference to FIG. 7, after a consumer picks the box-shaped container C2, the sheet 1 can be removed from the box-shaped container C2 and placed into a heating mechanism (such as a microwave stove) for heating purposes. After heating, the sheet 1 is wrapped around the box-shaped container C2 along the longitudinal direction L. Since the circumference in the longitudinal direction L is larger than the first circumference of the cyclic structure, the sheet 1 will be stretched outward by the outer surface of the box-shaped container C2, and the cyclic structure transforms from the first state into the second state to turn the thermally insulating strips 13 into wavy. Therefore, although the box-shaped container C2 may have high temperature after heating, the consumer can grip the ends of each rib 13 of the thermally insulating strips 13 away from the container C2 to hold the box-shaped container C2.

Figure 8:
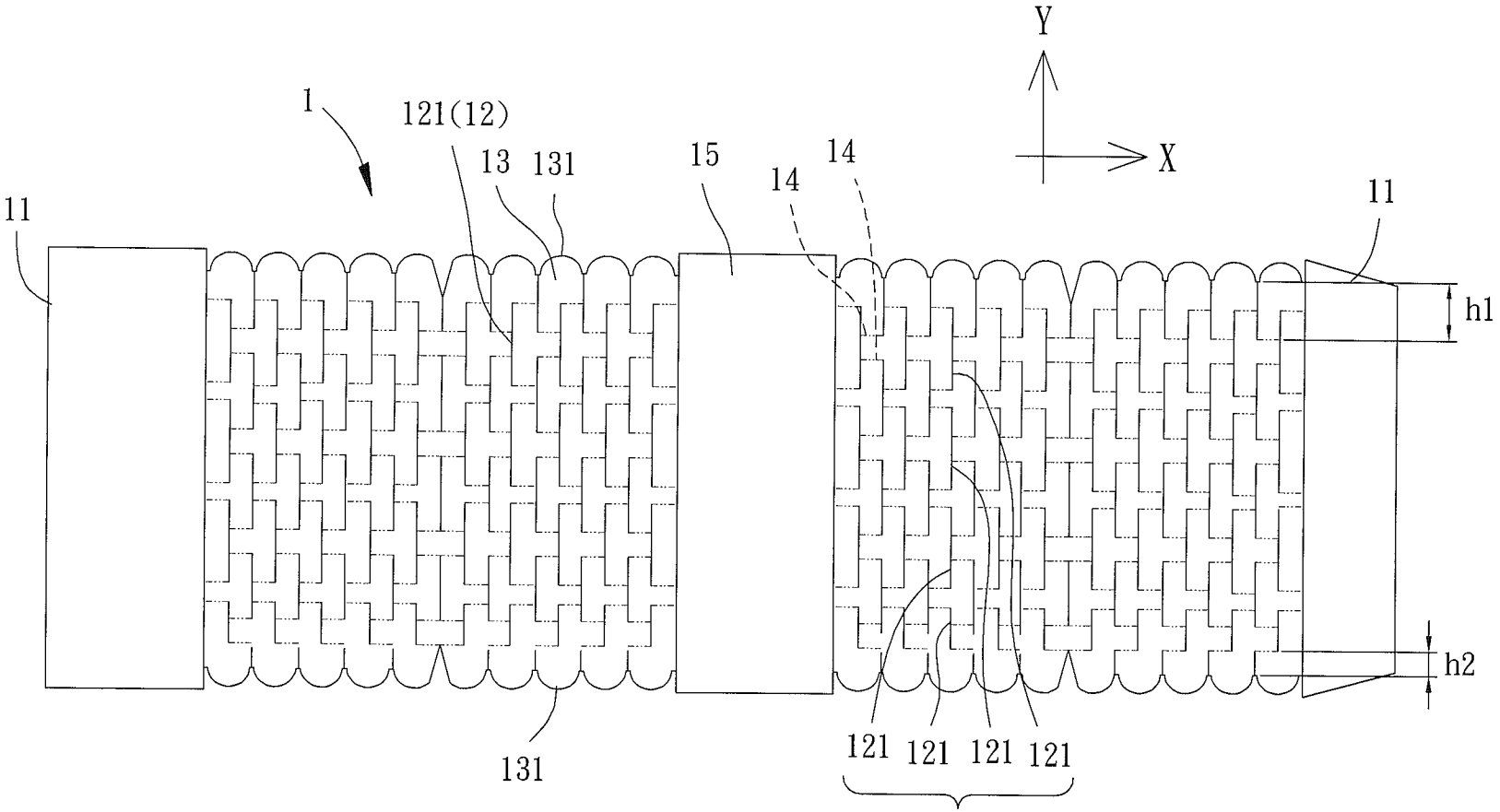
FIG. 8 is a perspective view of a thermally insulating member of a second embodiment according to the present disclosure.

With reference to FIG. 8, a thermally insulating member of a second embodiment of this disclosure is disclosed. The difference between the first and the second embodiments is that the sheet 1 has a plurality of pre-fold lines 14 in the second embodiment. Specifically, two ends of each slit 121 of the broken lines 12 respectively connect a pre-fold line 14. The pre-fold line 14 extends towards the two sides of the sheet 1 in the first direction X, and the pre-fold line 14 can extends to another broken line 12 adjacent to the broken line 12 in the first direction X. By such arrangement, with reference to FIG. 9, when the sheet 1 is mounted around a cylindrical container C1 and stretched outward by the outer surface of the container C1, the pre-fold lines 14 connected to the two ends of each slit 121 are bended to form fold lines 14'. Since the fold lines 14' also extends towards the two sides of the sheet 1 in the first direction X, the fold lines 14' can help the thermally insulating strips 13 to form the ribs 13*a* and stretchable ribs 13*b*. Thus, the heat dissipating holes 2 can be formed between the ribs 13 and stretchable ribs 13*b* following from that, and the thermally insulating strips 13 are rapidly formed into a predetermined shape. The thermally insulating strips 13 form the ribs 13*a* and stretchable ribs 13*b* easily with the plurality of pre-fold lines 14, effectively enhancing structural strength of the sheet 1. Besides, when the sheet 1 is stretched or pulled outward, the force applied to the sheet 1 is transmitted via the fold lines 14', such that the force is distribute by each broken line 12 of the sheet 1. As a result, the cyclic structure formed by the sheet 1 is able to spread out uniformly and transforms into the second state, effectively improving the convenience to use the thermally insulating member of the second embodiment of this disclosure.

Figure 9:
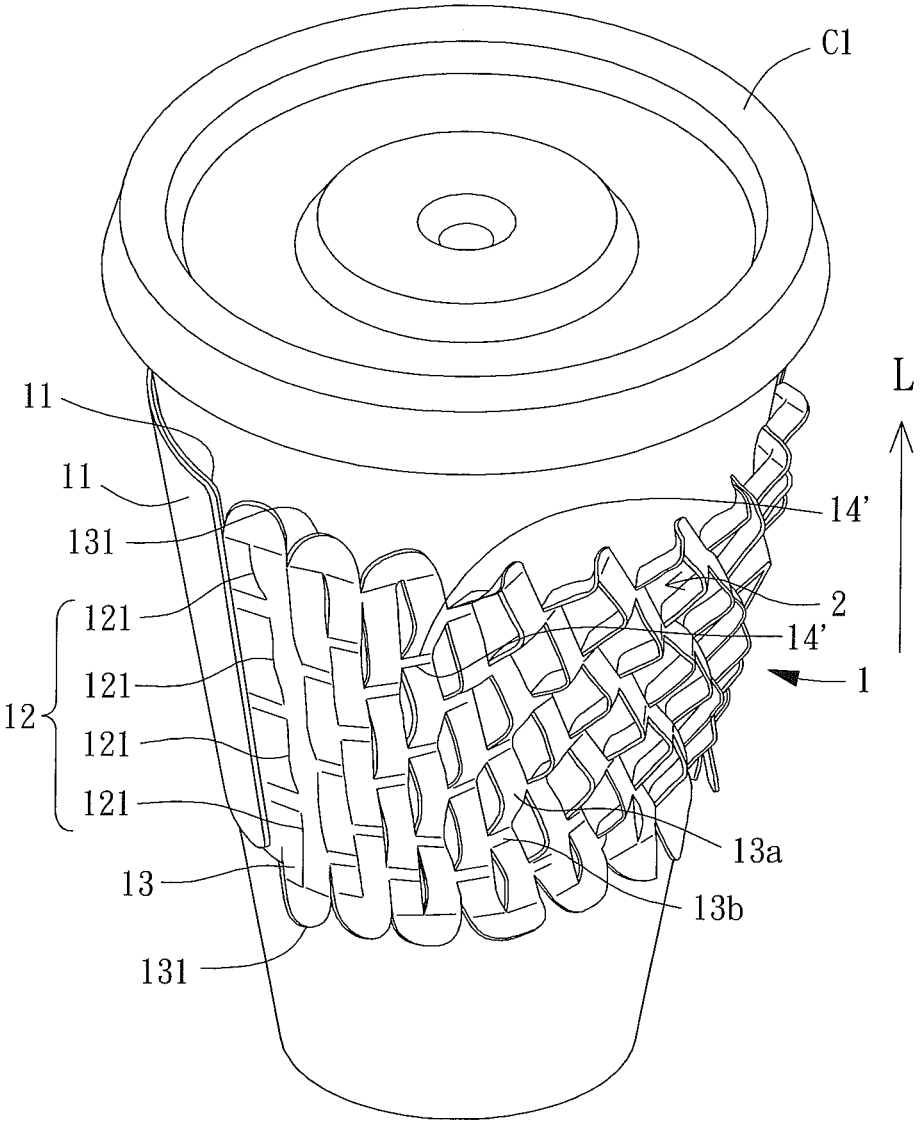
FIG. 9 is a perspective view illustrating use of the thermally insulating member of the second embodiment according to the present disclosure on a container.

Furthermore, with reference to FIGS. 8 and 9, for the plurality of slits 121 of each broken line 12, the slits 121 communicating with one of the peripheries of the sheet 1 in the second direction Y have a first length h1, and the slits 121 communicating with the other periphery of the sheet 1 in the second direction Y have a second length h2. The first length h1 is longer than the second length h2. By such arrangement, when the sheet 1 is mounted around the container C1, a wide opening and a narrow opening are respectively formed at the one and the other periphery since the sheet 1 is stretched outward. The wide opening is larger than the narrow opening and, thus, the cyclic structure formed by the sheet 1 can provide two openings with different sizes. A user can easily mount the sheet 1 around the container C1 via the wide opening, effectively improving the convenience to use the thermally insulating member of the second embodiment of this disclosure.

Figure 10:
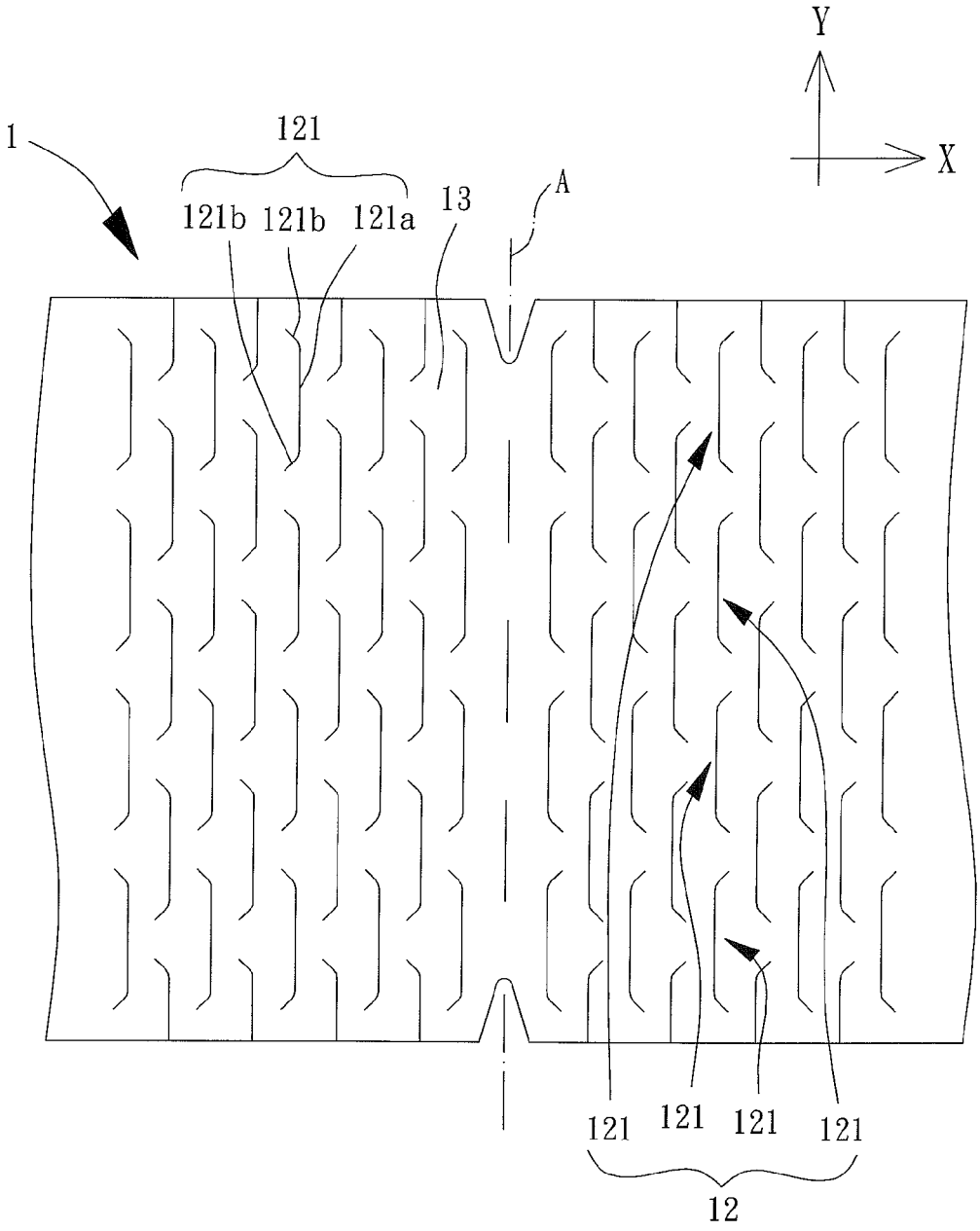
FIG. 10 is a partial perspective view of a thermally insulating member of a third embodiment according to the present disclosure with a sheet in a first state.

With reference to FIG. 10, a thermally insulating member of a third embodiment of this disclosure also includes a sheet 1 with each broken line 12 thereof includes a plurality of slits 121. In comparison with the sheets 1 of the thermally insulating members of the first and second embodiments which have a plurality of straight slits 121, in the third embodiment, each slit 121 has a first section 121*a* aligned with the second direction Y and two second sections 121*b* respectively connected to two ends of the first section 121*a*. The first section 121*a* can be parallel to the second direction Y. The two second sections 121*b* extend towards one of the sides of the sheet 1 in the first direction X. Therefore, each slit 121 with the first section 121*a* and the two second sections 121*b* is in a squama shape.

Figure 11:
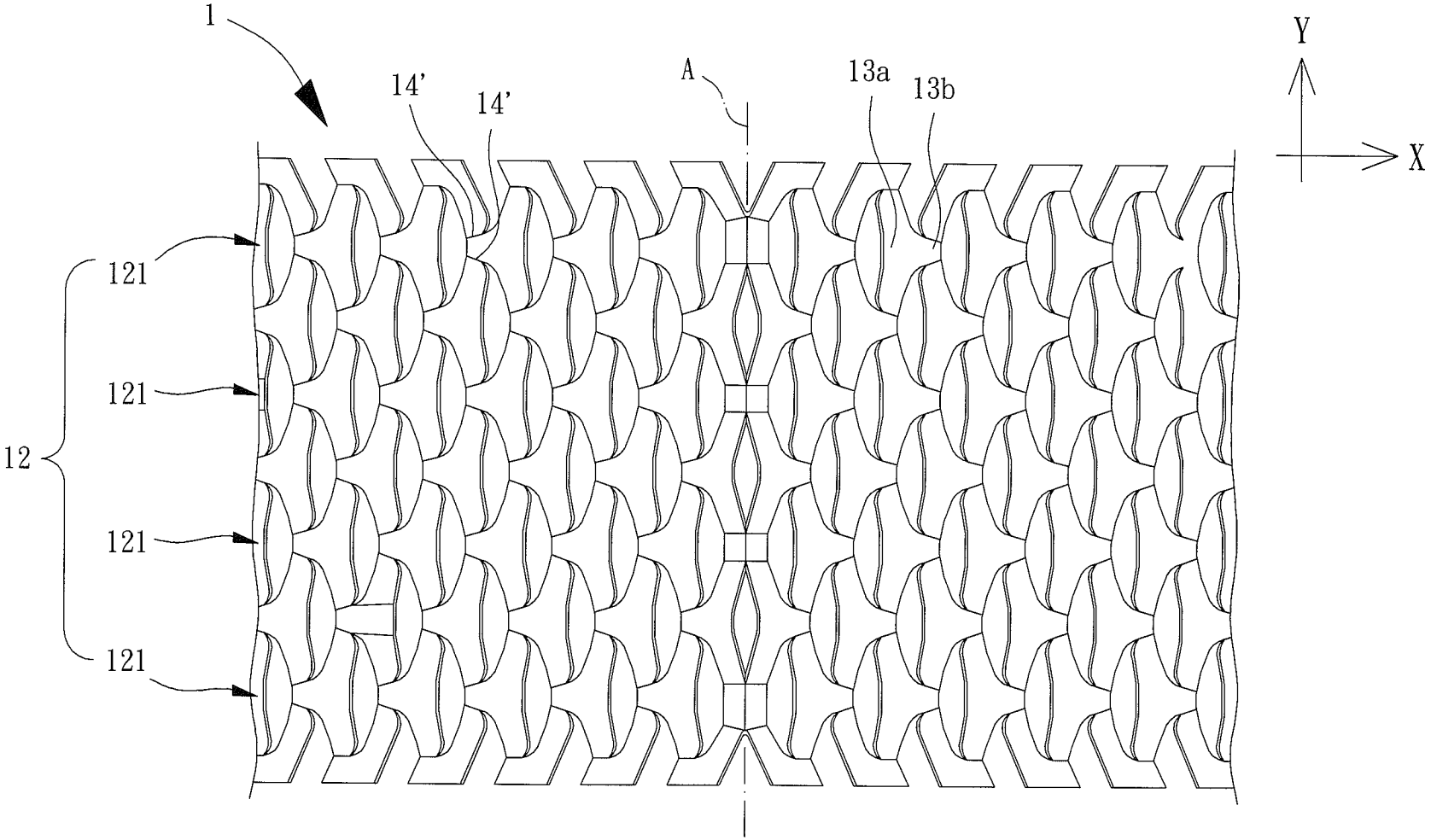
FIG. 11 is a partial perspective view of a thermally insulating member of the third embodiment according to the present disclosure with the sheet in a second state.

With reference to FIG. 11, in use of the thermally insulating member of the third embodiment, the two sides of the sheet 1 are also able to couple with each other so that the sheet 1 can form a cyclic structure. When the sheet 1 is stretched outward by a container, each of the junctions between the thermally insulating strips 13 and the plurality of slits 121 of the broken lines 12 will deflect away from the container. Meanwhile, since the two second sections 121*b* of each slit 121 extend towards in the first direction X, each of the second sections 121*b* can provide a guiding force to bend the adjacent thermally insulating strip 13 and, thus, a fold line 14' can be formed on the sheet 1. Each fold line 14' extends towards the two sides of the sheet 1 in the first direction X, so that the fold lines 14' can help the thermally insulating strips 13 to form the ribs 13*a* and stretchable ribs 13*b*. Thus, the heat dissipating holes 2 can be formed between the ribs 13 and stretchable ribs 13*b* following from that, and the thermally insulating strips 13 the thermally insulating strips 13 are rapidly formed into a predetermined shape.

Figure 12:
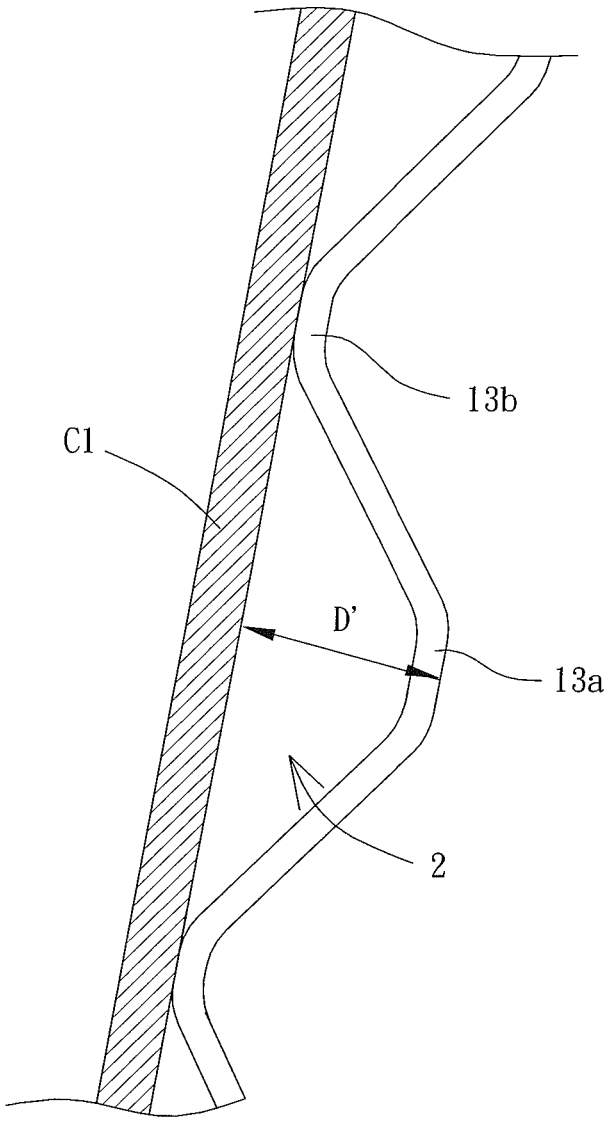
FIG. 12 is an enlarged view illustrating use of the thermally insulating member of the third embodiment according to the present disclosure on a container.

Moreover, with reference to FIG. 12, in this embodiment, since each slit 121 has a first section 121*a* and two second sections 121*b* connected to two ends of the first section 121*a*, each of the second sections 121*b* can be regarded as an extension of the slit 121 for increasing the equivalent length thereof. Thus, when the sheet 1 is mounted around the container C1, since the equivalent length of each slit 121 is increased, each of the portions of the insulating strips 13 that is not connected to the plurality of slits 121, namely, each of the portions of the insulating strips 13 connected to the spacing portions between the plurality of slits 121, will form a stretchable rib 13*b* with a shortened length, reducing the contact area between the stretchable rib 13*b* and the container C1. On the other hand, each of the junctions between the thermally insulating strips 13 and the plurality of slits 121 will to form a rib 13*a* with a prolonged length. A distance D' is formed between each rib 13*a* and the outer surface of the container C1 is longer than the distance D of the first embodiment shown in FIG. 5, which indicates that the volume of the heat dissipating holes 2 between the ribs 13 and stretchable ribs 13*b* is enlarged. Therefore, the thermally insulating effect of the thermally insulating member of the third embodiment of this disclosure can be further improved.

Figure 13:
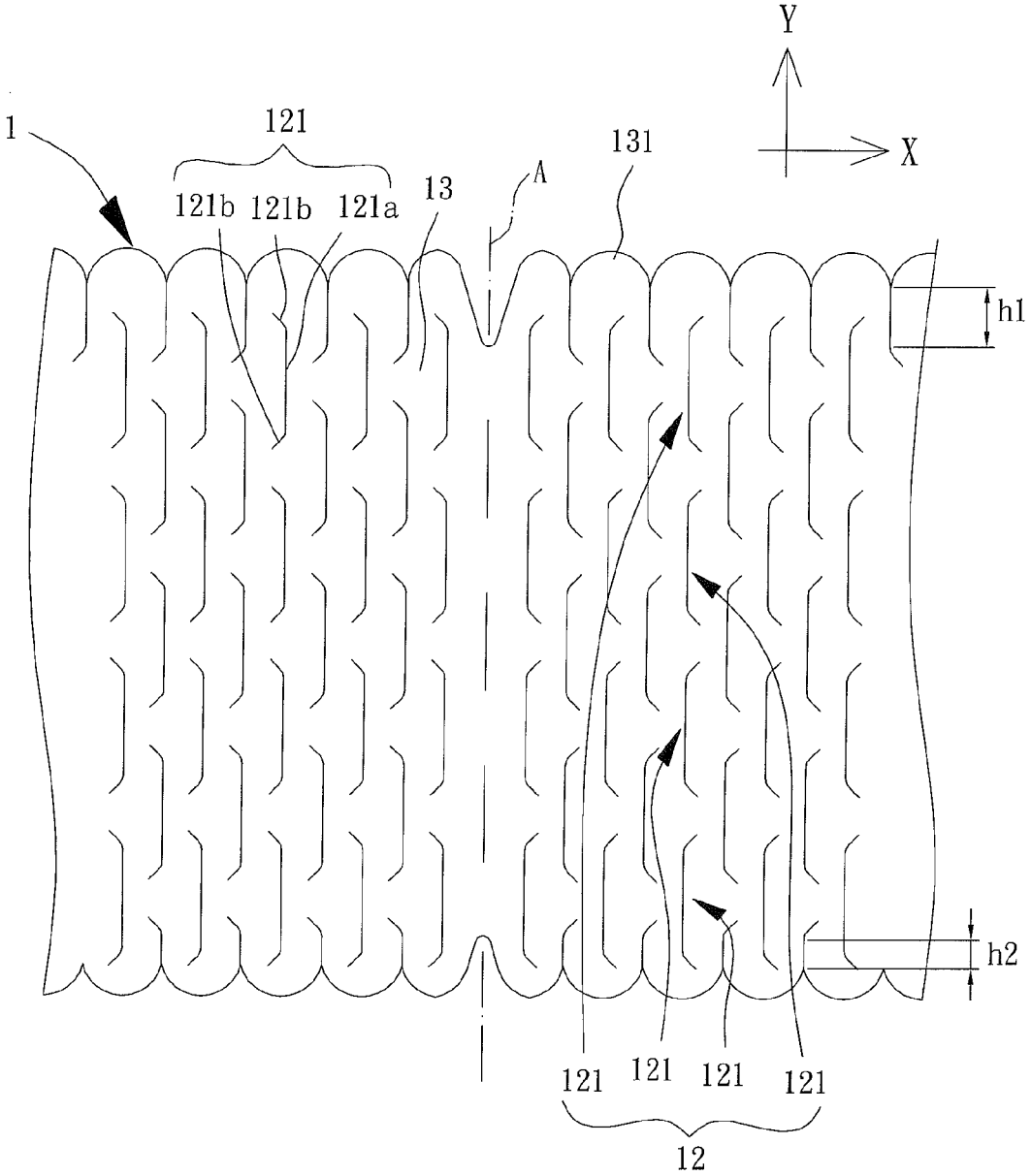
FIG. 13 is a perspective view of another example of the thermally insulating member of the third embodiment according to the present disclosure with a sheet in a first state.

With reference to FIG. 13, in another example of the sheet 1 of the thermally insulating member of the third embodiment, two ends in the second direction Y of each thermally insulating strip 13 have at least one rounded corner 131, respectively. The rounded corner 131 can prevent the user from getting cut by the peripheries of the sheet 1, especially while the user grabs the sheet 1 in quick motion. Besides, for the plurality of slits 121 of each broken line 12, the slits 121 communicating with one of the peripheries of the sheet 1 in the second direction Y have a first length h1, and the slits 121 communicating with the other periphery of the sheet 1 in the second direction Y have a second length h2. The first length h1 is longer than the second length h2. By such arrangement, when the sheet 1 is mounted around the container C1, the cyclic structure formed by the sheet 1 can provide a wide opening and a narrow opening with different sizes. A user can easily mount the sheet 1 around the container C1 via the wide opening, effectively improving the convenience to use the thermally insulating member of the third embodiment of this disclosure.

In accordance with the above structure, for the thermally insulating members of the second and third embodiments of this disclosure, fold line 14' are formed on the sheet 1 when the cyclic structure formed by the sheet 1 transforms from the first state into the second state. The fold lines 14' extends towards the two sides of the sheet 1 in the first direction X, and two ends of each slit 121 of the broken lines 12 respectively connect a fold line 14'. The fold lines 14' can let the cyclic structure transform from the first state into the second state smoothly, and help the thermally insulating strips 13 to form the ribs 13*a* and stretchable ribs 13*b*. Thus, the thermally insulating strips 13 are rapidly formed into a predetermined shape, effectively enhancing structural strength of the sheet 1 and improving the convenience to use the thermally insulating members of the second and third embodiments of this disclosure.

In addition, for the thermally insulating member of the third embodiment disclosed above, each slit 121 with the first section 121*a* and the two second sections 121*b* is in the squama shape. When the cyclic structure transforms into the second state, each of the second sections 121*b* can provide a guiding force to bend the adjacent thermally insulating strip 13 and, thus, a fold line 14' can be formed on the sheet 1. However, each slit 121 can be in a curved shape or a polygonal shape to obtain similar features of the slit 121 in the squama shape. Therefore, the slit 121 can be a straight line or in several types of nonlinear shape as required, which is not limited to the squama shape disclosed in the third embodiment.

Figure 14:
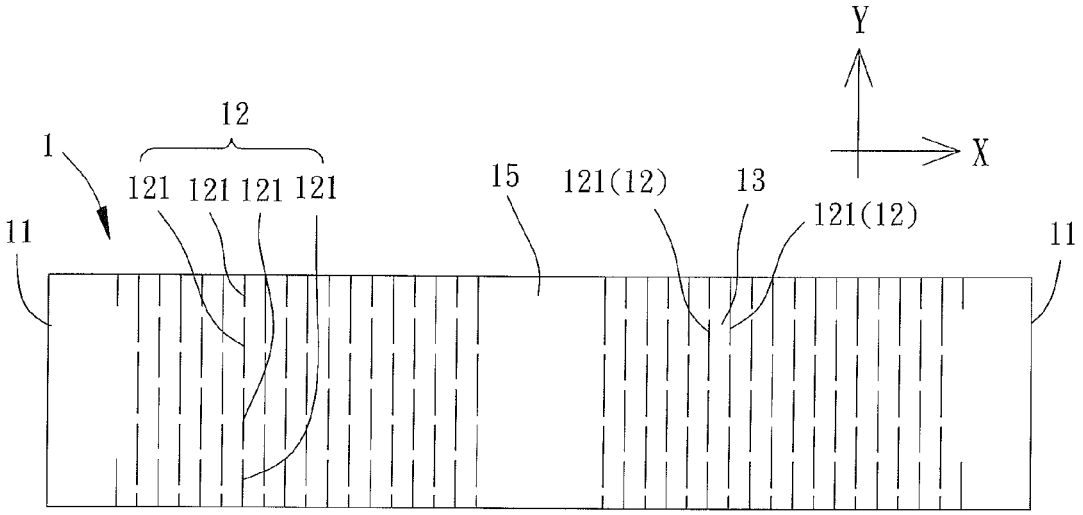
FIG. 14 is a perspective view of a thermally insulating member of a forth embodiment according to the present disclosure.
Figure 15:
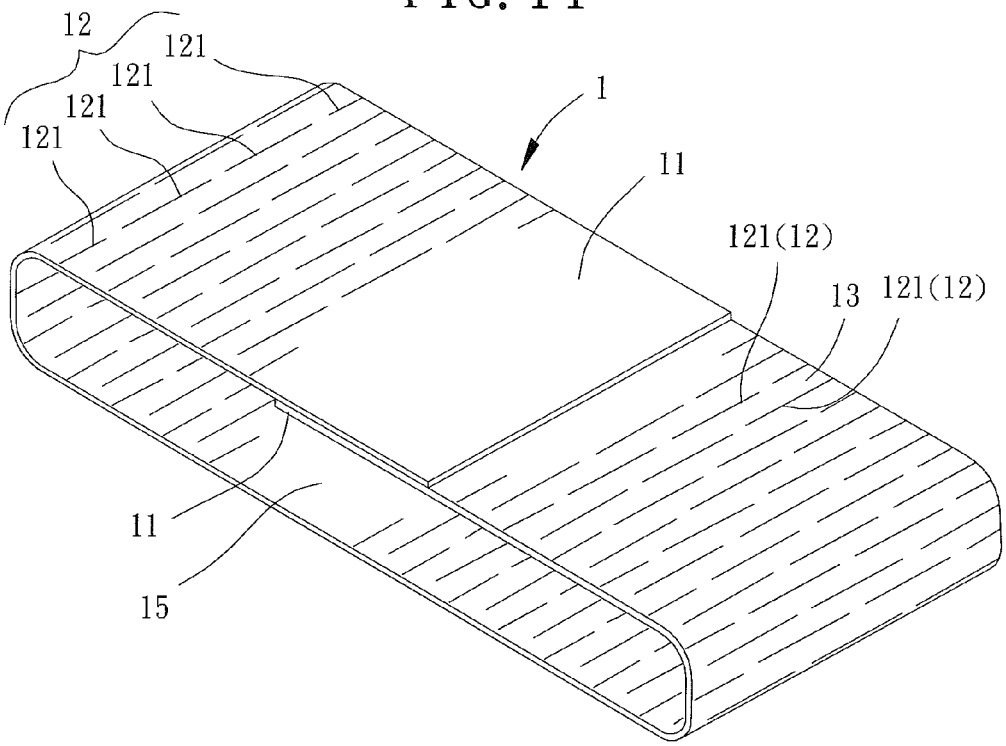
FIG. 15 is a perspective view of a cyclic structure formed by a sheet of the thermally insulating member of the forth embodiment according to the present disclosure.

With reference to FIG. 14, a thermally insulating member of a forth embodiment of this disclosure also includes a sheet 1. The difference between the first and forth embodiments is that, in this embodiment, the sheet 1 has a separation portion 15 located between the two coupling portions 11. The separation portion 15 is an area without any broken line 12. Namely, the plurality of broken lines 12 is arranged between the separation portion 15 and each of the coupling portions 11. Along with reference to FIG. 15, when the coupling portions 11 couple with each other so that the sheet 1 form a cyclic structure, the separation portion 15 and the two coupling portions 11 are respectively located in two opposite positions on the cyclic structure. Therefore, with the separation portion 15, the sheet 1 is prevented from unsatisfactory structural strength due to continuous presence of the broken lines 12. Moreover, the sheet 1 is in the form of a continuous surface at the separation portion 15 and the two coupling portions 11, which can not be deformed by the container C1 or the box-shaped container C2 as mentioned above. Therefore, the separation portion 15 and the two coupling portions 11 allows the force applied to the sheet 1 to focus on the plurality of broken lines 12, which makes the thermally insulating strips 13 form the ribs 13*a* and stretchable ribs 13*b* more easily. On the other hand, the separation portion 15 can share the force applied to the sheet 1, potentially preventing the thermally insulating strips 13 from avulsion.

Figure 16:
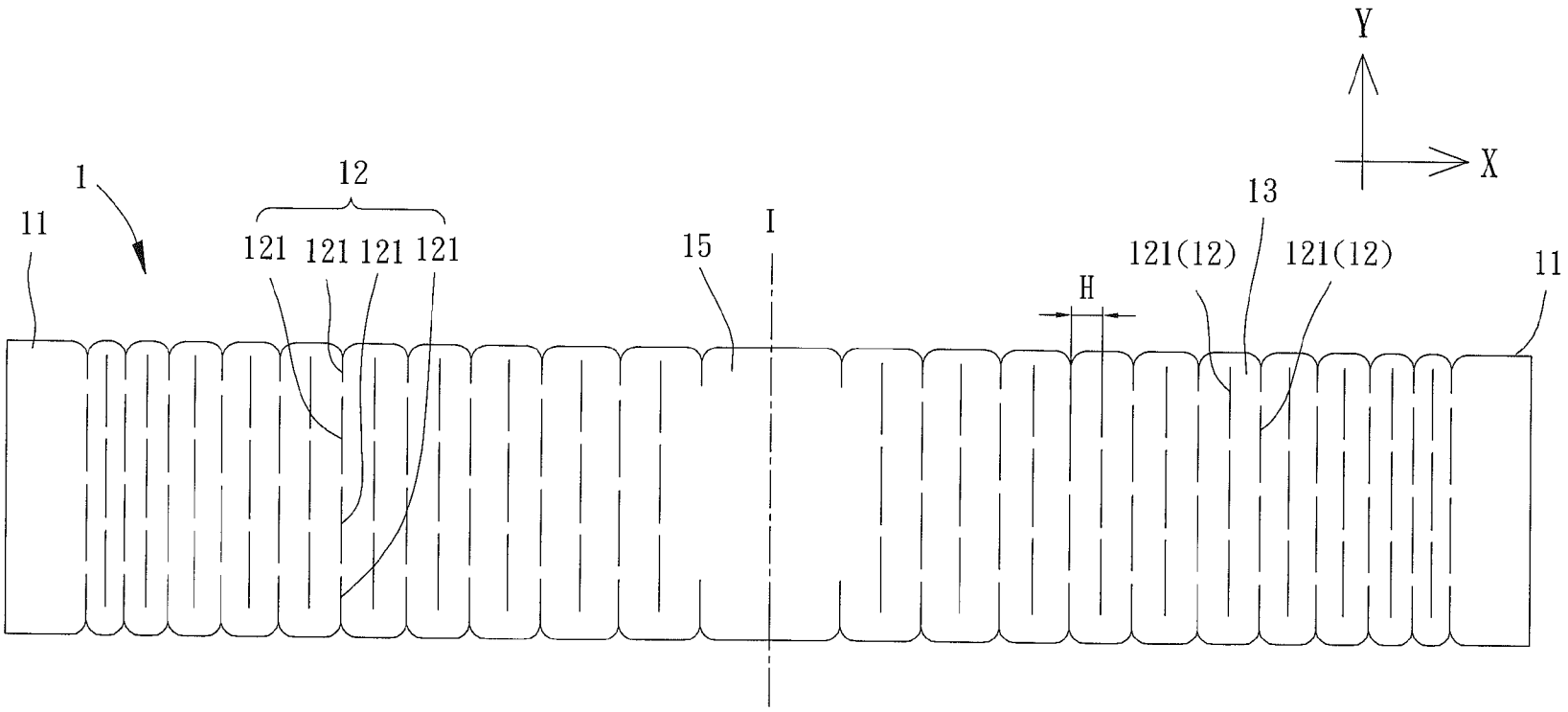
FIG. 16 is a perspective view of a thermally insulating member of one embodiment according to the present disclosure with every two adjacent broken lines unequally spaced from each other.

With reference to FIG. 16, two adjacent broken lines 12 are spaced from each other in the first direction X by a spacing H. The spacings H of every two adjacent broken lines 12 are even in the first, second, third, and forth embodiments, which indicates that every two adjacent broken lines 12 are equally spaced from each other. However, every two adjacent broken lines 12 can be unequally spaced from each other. Specifically, as shown in FIG. 16, the sheet 1 has an axis I parallel to the second direction Y. The spacing H of two adjacent broken lines 12 near the axis I can be larger than the spacing H of two adjacent broken lines 12 away from the axis I. Namely, every two adjacent broken lines 12 are spaced from each other in the first direction X by a variable spacing H, and the spacings H of every two adjacent broken lines 12 decrease from the axis I towards the two coupling portions 11. In addition, the sheet 1 can have a separation portion 15 as mentioned in the forth embodiment. The axis I passes through the separation portion 15 and, thus, the separation portion 15 can share the force applied to the sheet 1 when the sheet 1 is stretched or pulled outward, allowing the cyclic structure formed by the sheet 1 to spread out symmetrically bisected by the axis I. As a result, the thermally insulating member of the embodiments of this disclosure can possess uniform thermally insulating effect and provide decent appearance.

Figure 17:
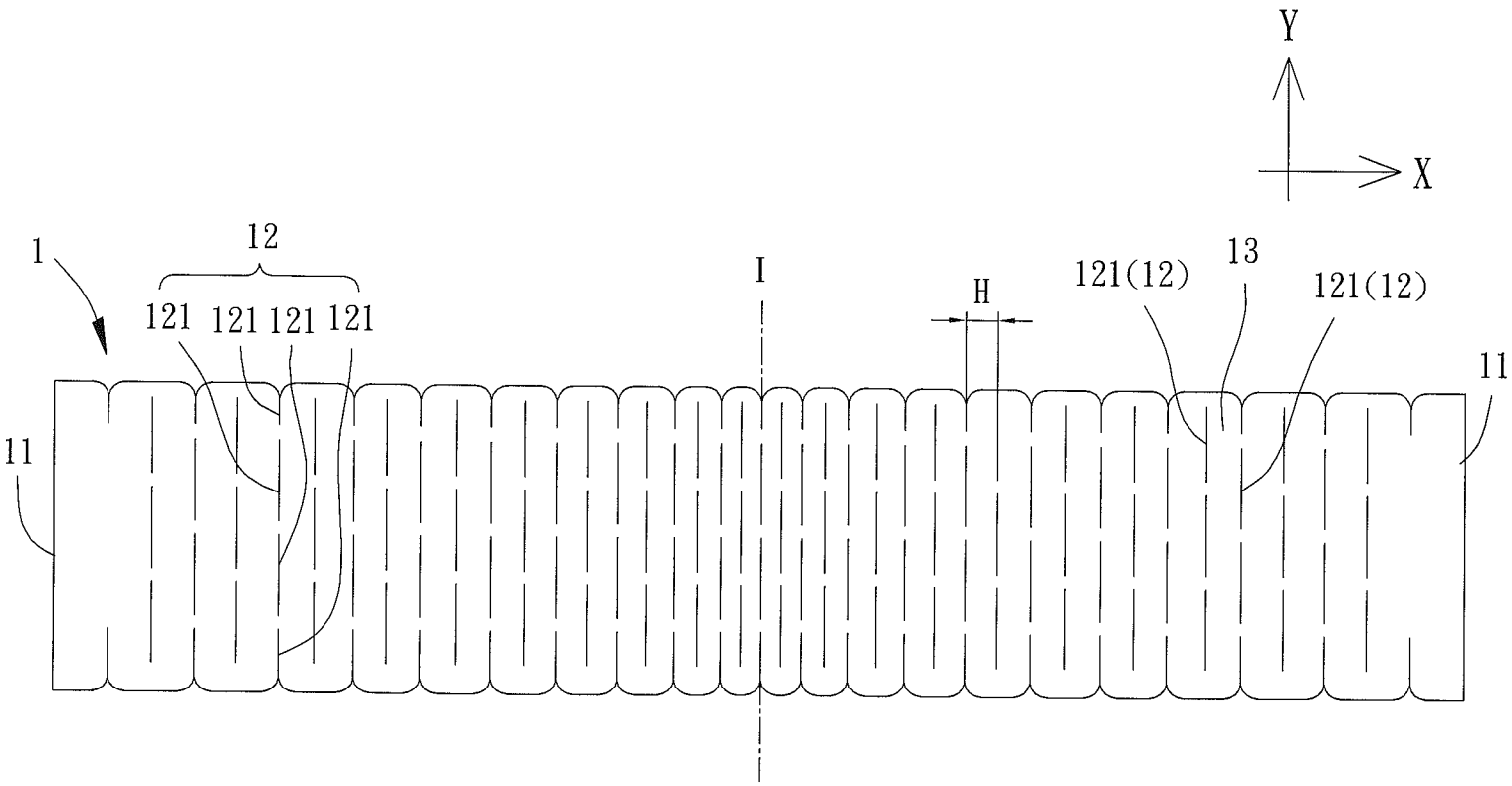
FIG. 17 is a perspective view of a thermally insulating member of another embodiment according to the present disclosure with every two adjacent broken lines unequally spaced from each other.

With reference to FIG. 17, in some embodiments of this disclosure, the sheet 1 also has an axis I parallel to the second direction Y. However, the spacing H of two adjacent broken lines 12 near the axis I can be smaller than the spacing H of two adjacent broken lines 12 away from the axis I. Namely, every two adjacent broken lines 12 are spaced from each other in the first direction X by a variable spacing H, and the spacings H of every two adjacent broken lines 12 increase from the axis I towards the two coupling portions 11. It can be understood by one of ordinary skill in the art that bases on the examples shown in FIGS. 16 and 17, the spacings H of every two adjacent broken lines 12 can increase from the axis I towards one of the coupling portions 11, while decrease from the axis I towards the other coupling portion 11. By letting every two adjacent broken lines 12 be unequally spaced from each other on the sheet 1, the two adjacent broken lines 12 spaced from each other in the first direction X by a variable spacing H not only help the thermally insulating strips 13 to form the ribs 13*a* and stretchable ribs 13*b*, but also form the end of each rib 13 of the thermally insulating strips 13 away from a container to into a curved shape, allowing a user hold the sheet 1 comfortably.

Figure 18:
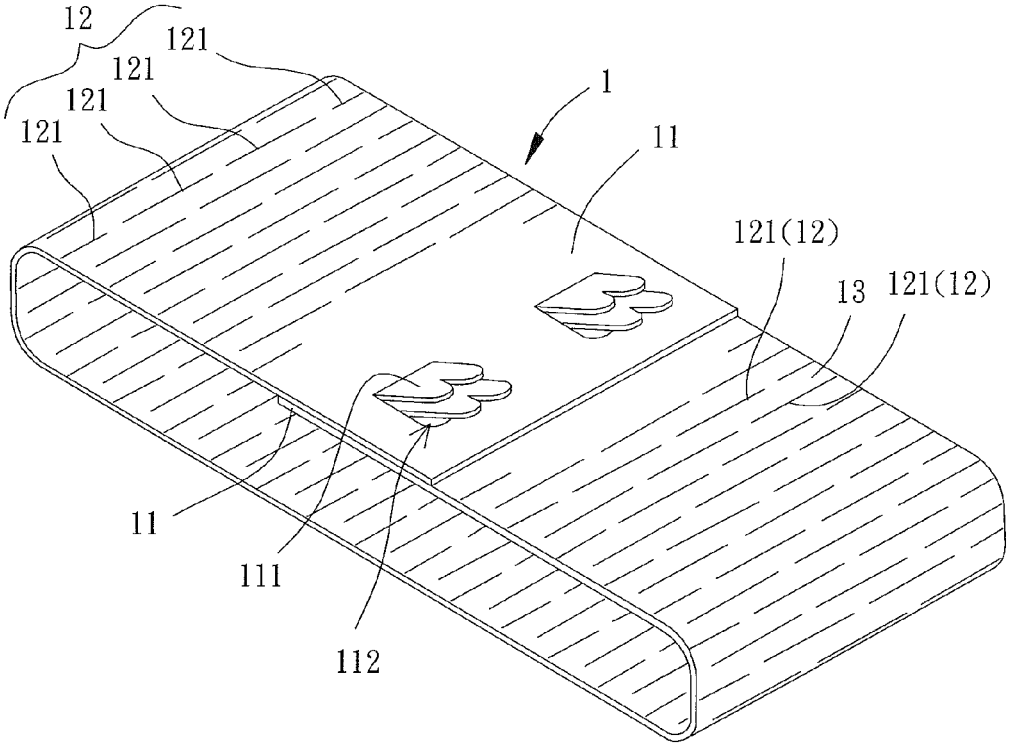
FIG. 18 is a perspective view illustrating another example of coupling portions of the thermally insulating member according to the present disclosure.

With reference to FIG. 18, although in the embodiments as mentioned above, the coupling portions 11 are coupled with each other by an adhesive, in implementation of the thermally insulating member according to the present disclosure, to allow easy use by consumers, a coupling mechanism can directly be formed on the two coupling portions 11 of the thermally insulating member by cutting. The coupling mechanism includes a coupling member 111 in one of the coupling portions 11 and a coupling hole 112 on the other coupling portion 11. The coupling member 111 can be detachably engaged in the coupling hole 112. Thus, the coupling portions 11 of the sheet 1 do not have to be bonded to each other by an adhesive. Instead, the coupling portions 11 of the sheet 1 can be coupled to each other by the coupling member 111 and the coupling hole 112. In addition, the coupling portions 11 of the sheet 1 can be coupled to each other by a stapling nail, a tape, or a hotmelt.

Figure 19:
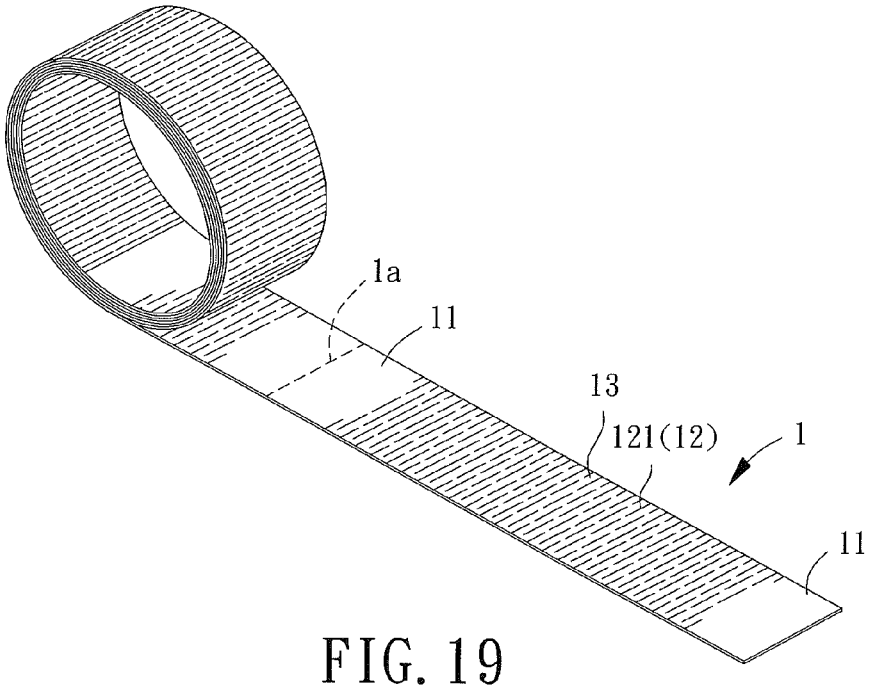
FIG. 19 is a perspective view illustrating a plurality of thermally insulating members according to the present disclosure connected together via the coupling portions.

With reference to FIG. 19, in implementation of the thermally insulating member according to the present disclosure, a plurality of thermally insulating members is manufactured continuously. Specifically, sheets 1 of a plurality of thermally insulating members are connected together via the coupling portions 11 with a cutting line 1*a* formed between two adjacent sheets 1. Thus, sheets 1 of a plurality of thermally insulating member can be coiled into a roll to allow easy transportation and storage of the thermally insulating members according to the present disclosure. A user can get a thermally insulating member by simply tearing a sheet 1 along a corresponding cutting line 1*a*. The thermally insulating member can be immediately used after coupling the coupling portion 11 of the sheet 1 with each other so that the sheet 1 forms a cyclic structure.

Figure 20:
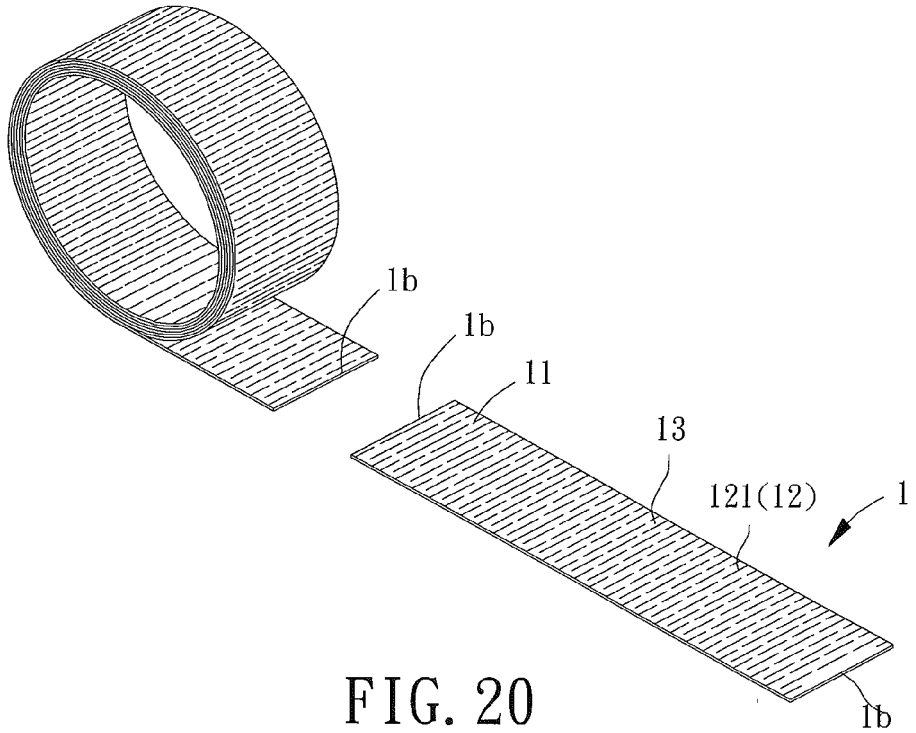
FIG. 20 is a perspective view illustrating a plurality of thermally insulating members according to the present disclosure connected together.
Figure 21:
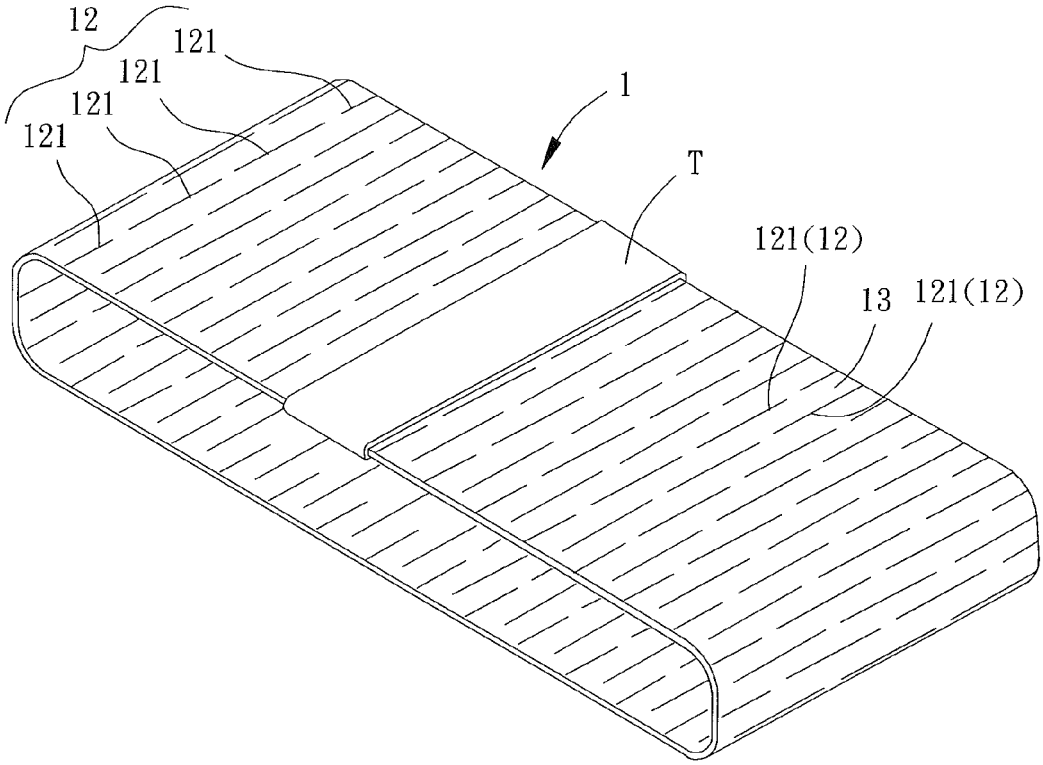
FIG. 21 is a perspective view illustrating a thermally insulating member of another embodiment according to the present disclosure with two sides of a sheet coupled to each other by a tape.

With reference to FIG. 20, in implementation of the thermally insulating member according to the present disclosure, a plurality of thermally insulating members is manufactured continuously, and the sheets 1 of a plurality of thermally insulating members are connected together without the coupling portions 11. Therefore, a user can cut a sheet 1 with any length as required. The sheet 1 cut by the user has two cutting surfaces 1*b* at the two sides thereof. The thermally insulating member can be immediately used after coupling the two cutting surfaces 1*b* of the sheet 1 with each other by a stapling nail, a tape, or a hotmelt so that the sheet 1 forms a cyclic structure. For example, with reference to FIG. 21, the use can couple the two cutting surfaces 1*b* of the sheet 1 by a tape T.

With the previously disclosed structural features, the main characters of the first, second, third, and forth embodiments of thermally insulating member of the present disclosure lie in that:

By providing a thermally insulating member including a sheet, with the sheet 1 including a first direction X and a second direction Y perpendicular to each other, with the sheet 1 having two sides spaced from each other in the first direction X, with the sheet 1 including a plurality of broken lines 12 extending along the second direction Y, with two adjacent broken lines 12 are spaced from each other in the first direction X, with each broken line 12 including a plurality of slits 121, and with two adjacent slits 121 spaced from each other in the second direction Y, a thermally insulating strip 13 can be defined between two adjacent broken lines 1. By such arrangement, the two sides of the sheet 1 are able to couple with each other so that the sheet 1 can form a cyclic structure. When the sheet 1 is mounted around a container, the sheet 1 is stretched outward by a outer surface of the container if the circumference of the cyclic structure is smaller than a circumference of the outer surface of the container, and ribs 13*a* and stretchable ribs 13*b* are formed on each thermally insulating strip 13. Therefore, a distance D is formed between each rib 13*a* and the outer surface of the container, the stretchable ribs 13*b* abut against the outer surface of the container, and each thermally insulating strip 13 is in point contact with the outer surface of the container.

In accordance with the above structure, the thermally insulating member of this disclosure is in a spread out state before use. The thermally insulating strips 13 are flat, such that the thermally insulating member is mainly formed by the plane sheet 1. In other words, the sheet 1 of the thermally insulating member of this disclosure is plane with smaller thickness, effectively reducing the volume of a plurality of thermally insulating members.

Besides, the sheet 1 of the thermally insulating member of this disclosure can be in point contact with the outer surface of the container via the ribs 13*a* and the stretchable ribs 13*b* of each thermally insulating strip 13. Thus, the sheet 1 has a limited contact area with the container, effectively reducing the rate of the temperature transmission between the container and the sheet 1. As a result, the thermally insulating effect of the thermally insulating member of this disclosure is improved.

Furthermore, a heat dissipating hole 2 is defined between the rib 13*a* of one of the thermally insulating strips 13 and the stretchable rib 13*b* of another adjacent thermally insulating strip 13. The sheet 1 of the thermally insulating member of this disclosure includes a plurality of heat dissipating holes 2 distributed on it. The heat dissipating holes 2 penetrate through the sheet 1 and communicate with the outer surface of the container C1 and, thus, the heat dissipating holes 2 are fulfilled with air. Therefore, the air in the heat dissipating holes 2 can reduced the rate of the temperature transmission on the sheet 1, further improving the thermally insulating effect of the thermally insulating member of this disclosure.

In sum, the thermally insulating member of the present disclosure can improve the thermally insulating effect and reduce the volume thereof. Thus, a customer can directly hold the thermally insulating member to avoid scalding by high temperature of the hot food in a container, and the volume and costs of a plurality of thermally insulating members in storage or during transportation are reduced.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A thermally insulating member comprising a plane sheet including a sheet, wherein the sheet includes a first direction and a second direction perpendicular to each other, wherein the sheet is able to form a cyclic structure encircling the second direction, wherein the sheet includes a plurality of broken lines extending along a second direction, wherein two adjacent broken lines are spaced from each other in the first direction, wherein each broken line includes a plurality of slits, wherein two adjacent slits are spaced from each other in the second direction, wherein each slit has a first section aligned with the second direction, wherein each of two opposing ends of the first section respectively connects a second section, wherein the two second sections extend at an angle to the first section towards a same side of the sheet in the first direction, and wherein the sheet is able to be stretched in a first direction to form a wavy sheet with at least some of the plurality of slits forming heat dissipating holes.

2. The thermally insulating member as claimed in claim 1, wherein the plurality of slits of two adjacent broken lines is arranged in a staggered manner in the first direction.

3. The thermally insulating member as claimed in claim 2, wherein the plurality of slits of two adjacent broken lines is arranged in an overlapping staggered manner in the first direction, wherein a slit of one of the broken lines overlaps with another slit of the other broken line in the first direction, and wherein the two slits are located in different positions in the second direction.

4. The thermally insulating member as claimed in claim 1, wherein a thermally insulating strip is defined between two adjacent broken lines, wherein each thermally insulating strip has two ends spaced from each other in the second direction, and wherein each end of the thermally insulating strip has at least one rounded corner.

5. The thermally insulating member as claimed in claim 1, wherein the sheet has two peripheries spaced from each other in the second direction, wherein the slits communicating with one of the peripheries have a first length, wherein the slits communicating with the other periphery have a second length, and wherein the first length is longer than the second length.

6. The thermally insulating member as claimed in claim 1, wherein the sheet has two sides spaced from each other in the first direction, wherein each side of the sheet has a coupling portion, wherein the plurality of broken lines is arranged between the two coupling portions, and wherein the two coupling portions are able to couple with each other.

7. The thermally insulating member as claimed in claim 6, wherein the sheet has a separation portion located between the two coupling portions, and wherein the plurality of broken lines is arranged between the separation portion and each of the coupling portions.

8. The thermally insulating member as claimed in claim 1, wherein two adjacent broken lines are spaced from each other in the first direction by a spacing, the spacings of every two adjacent broken lines are even.

9. The thermally insulating member as claimed in claim 6, wherein two adjacent broken lines are spaced from each other in the first direction by a spacing, wherein the sheet has an axis parallel to the second direction, and wherein the spacings of every two adjacent broken lines decrease or increase from the axis towards the two coupling portions.

10. The thermally insulating member as claimed in claim 6, wherein one of the coupling portions is applied with an adhesive, and wherein the other coupling portion is bonded to the coupling portion with the adhesive to form the sheet in the cyclic structure.

11. The thermally insulating member as claimed in claim 6, wherein a coupling mechanism is formed on the two coupling portions, and wherein the coupling mechanism includes a coupling member in one of the coupling portions and a coupling hole on the other coupling portion.

12. The thermally insulating member as claimed in claim 1, wherein the sheet means for being mounted around a container, wherein the cyclic structure has a first state and a second state, wherein the cyclic structure has a first circumference in the first state, wherein the first circumference is smaller than a circumference of the outer surface of the container, wherein the cyclic structure has a second circumference in the second state, wherein the second circumference is equal to the circumference of the outer surface of the container, and wherein the sheet is stretched outward by the container to transform the cyclic structure from the first state into the second state.

13. The thermally insulating member as claimed in claim 12, wherein a thermally insulating strip is defined between two adjacent broken lines, wherein each of the junctions between the thermally insulating strips and the plurality of slits of the broken lines forms a rib, wherein a distance is formed between each rib and the outer surface of the container, and wherein each of the portions of the insulating strips connected to the spacing portions between the plurality of slits forms a stretchable rib.

14. The thermally insulating member as claimed in claim 13, wherein for two thermally insulating strips adjacent to each other, a rib of one of the thermally insulating strips is align with a stretchable rib of the other thermally insulating strip in the first direction, wherein a substantially rhombic heat dissipating hole is defined between rib and the stretchable rib, and wherein the heat dissipating hole penetrates through the sheet and communicates with the outer surface of the container.

15. The thermally insulating member as claimed in claim 12, wherein a thermally insulating strip is defined between two adjacent broken lines, wherein each of the second sections provides a guiding force to bend the adjacent thermally insulating strip and form a fold line on the sheet.

* * * * *